US008683934B2

(12) United States Patent
Hey

(10) Patent No.: US 8,683,934 B2
(45) Date of Patent: Apr. 1, 2014

(54) COMPACT SELF-MONITORING SELF-STABILIZING AIR DISPLACEMENT WATERCRAFT LIFT

(75) Inventor: Kenneth E. Hey, Bellevue, WA (US)

(73) Assignee: Sunstream Corporation, Kent, WA (US)

( * ) Notice: Subject to any disclaimer, the term of this patent is extended or adjusted under 35 U.S.C. 154(b) by 193 days.

(21) Appl. No.: 13/315,239

(22) Filed: Dec. 8, 2011

(65) Prior Publication Data

US 2012/0312214 A1 Dec. 13, 2012

Related U.S. Application Data

(60) Provisional application No. 61/421,182, filed on Dec. 8, 2010.

(51) Int. Cl.
*B63C 1/02* (2006.01)

(52) U.S. Cl.
USPC ..... 114/46; 114/44

(58) Field of Classification Search
USPC ..... 114/44, 45, 46, 48; 405/3, 7
See application file for complete search history.

(56) References Cited

U.S. PATENT DOCUMENTS

| | | | | |
|---|---|---|---|---|
| 3,895,592 | A | 7/1975 | King | |
| 4,018,179 | A | 4/1977 | Rutter | |
| 4,072,119 | A | 2/1978 | Williams | |
| 5,860,379 | A | 1/1999 | Moody | |
| 5,908,264 | A | 6/1999 | Hey | |
| 6,032,601 | A | 3/2000 | Gates | |
| 6,422,167 | B1 * | 7/2002 | Bridges | 114/44 |
| 6,547,485 | B2 | 4/2003 | Elson | |
| 6,823,809 | B2 | 11/2004 | Hey | |
| 6,976,442 | B2 | 12/2005 | Hey et al. | |
| 7,096,809 | B1 | 8/2006 | Victor | |
| 7,246,970 | B2 | 7/2007 | Hey | |
| 7,325,503 | B1 | 2/2008 | Vaughn | |
| 2008/0008528 | A1 | 1/2008 | Hey et al. | |
| 2009/0191000 | A1 | 7/2009 | Kloster et al. | |

FOREIGN PATENT DOCUMENTS

| | | |
|---|---|---|
| JP | 3428706 | 5/1995 |

* cited by examiner

*Primary Examiner* — Lars A Olson
(74) *Attorney, Agent, or Firm* — Davis Wright Tremaine LLP; George C. Rondeau, Jr.

(57) ABSTRACT

A free-floating, compact, self-stabilizing, self-monitoring, remote-controlled, shallow-water, solar, high-speed, air displacement watercraft lift constructed of polyethylene tanks, and non-metallic structure. This device provides vertical lifting by inflating 4 or more air tanks at once using a blower for each tank, pushing water out an exit hole on the bottom of each tank. Each tank has an electric valve for filling and another for exhausting air. Pairs of tanks are pivotally connected along the centerline, and pairs of tanks are connected with a union tube inside the axles. A monitoring system fills the air tanks if air leaks. The width of the lift is adjusted by adjusting the center bunk height, or by adding a spacer.

37 Claims, 37 Drawing Sheets

COMPACT SELF-MONITORING SELF-STABILIZING AIR DISPLACEMENT WATERCRAFT LIFT

FIELD OF THE INVENTION

Figure 1:
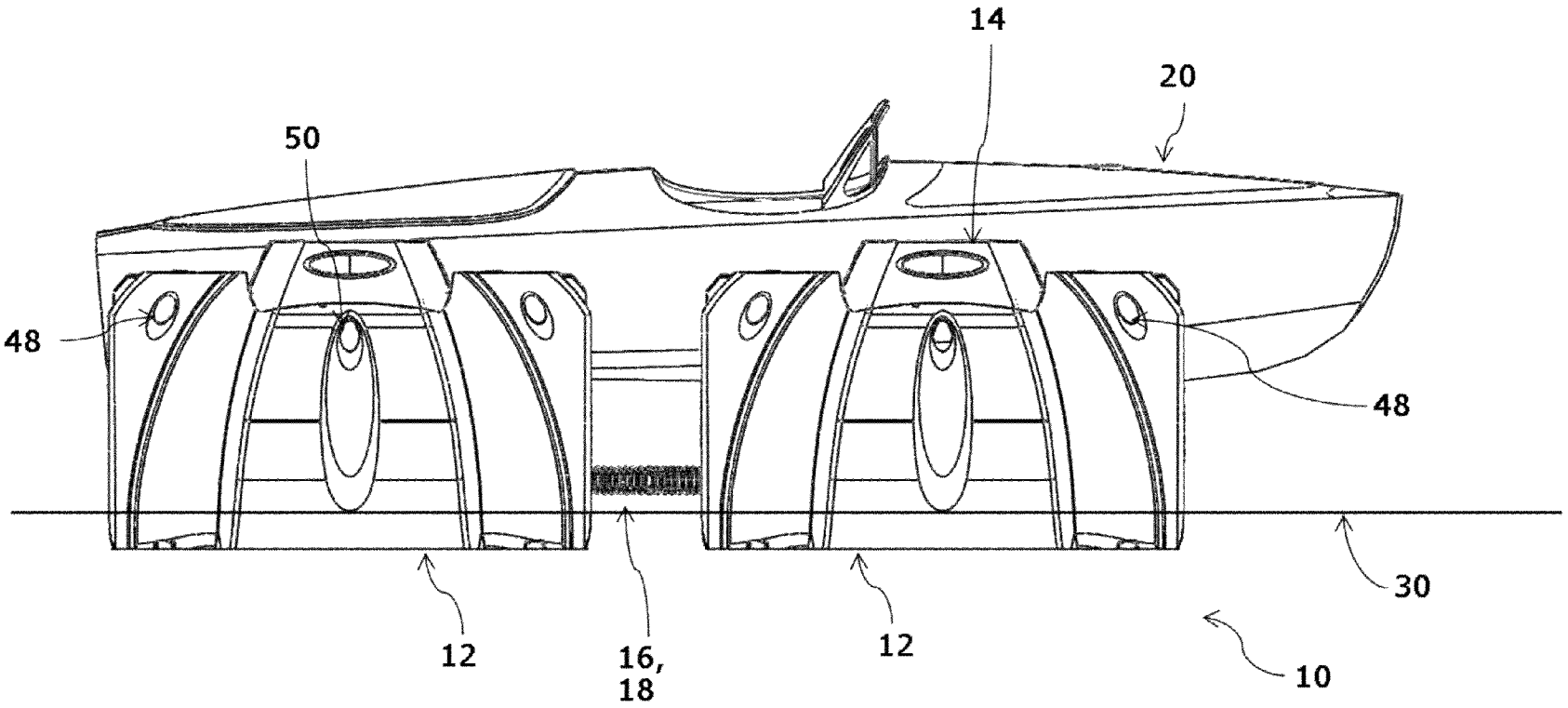

The present invention relates to a floating watercraft lift.

BACKGROUND OF THE INVENTION

This invention generally relates to a floating boat lift system for a watercraft which uses air to displace water in tanks to lift a watercraft (air-displacement floating boat lift).

The use of air displacement floating boat lifts are well known. A number of designs are currently known that provide this basic function. Most use a plurality of air tanks, connected to a blower and valves using hoses. Examples of these are U.S. Pat. Nos. 7,325,503, 5,860,379, Ser. No. 11/690,732, U.S. Pat. Nos. 6,547,485, 3,895,592, 4,018,179, 4,072,119. All of these designs use hoses to transfer the air from the blower to the air tank. The hoses often are routed underwater, exposed to UV light, and experience repetitive loading from wave action. All of these factors make the air hoses the most common cause for product failure for many of these designs.

A common problem with air displacement floating boat lifts is maintaining stability during lifting and launching. 5503 and 0732 address this by using stabilizing arms forming a four bar linkage. 2119 uses two pairs of trunnions. These arms can have durability issues since they experience high repetitive loading in a wavy environment. Designs similar to 5503 need to be attached to a U-shaped dock within limits of width, which can limit the locations for installation of this design. Designs without stabilizing arms, such as 0379 and 7485 often require the operator to adjust 4 air valves to maintain stability.

Designs like 5503 are comprised of bunks which support the boat, a frame which supports the bunks and secure the floats. Designs such as 0379 use air-filled bags to support the boat, which are not as durable, tend to have less lifting range, and are more difficult to secure in place. This design references an embodiment with level sensors and blow-out valves which would be used for leaks.

Another challenge for several designs such as 5503, 2097, 8179 and 0732 is connecting the frame to the plastic or fiberglass air tanks. High loading and fatigue loading can cause failures in plastic or fiberglass air tanks.

Fitting into a 10 ft slip has been a challenge for free-floating air displacement boat lifts since typical max boat beams are 8.5 ft (for highway regulations), which does not leave much space between the boat and dock. This invention is believed to be the first free-floating air displacement lift with rigid structure to fit in a 10 ft slip with an 8.5 ft boat

BRIEF DESCRIPTION OF THE SEVERAL VIEWS OF THE DRAWING(S)

Figure 2:
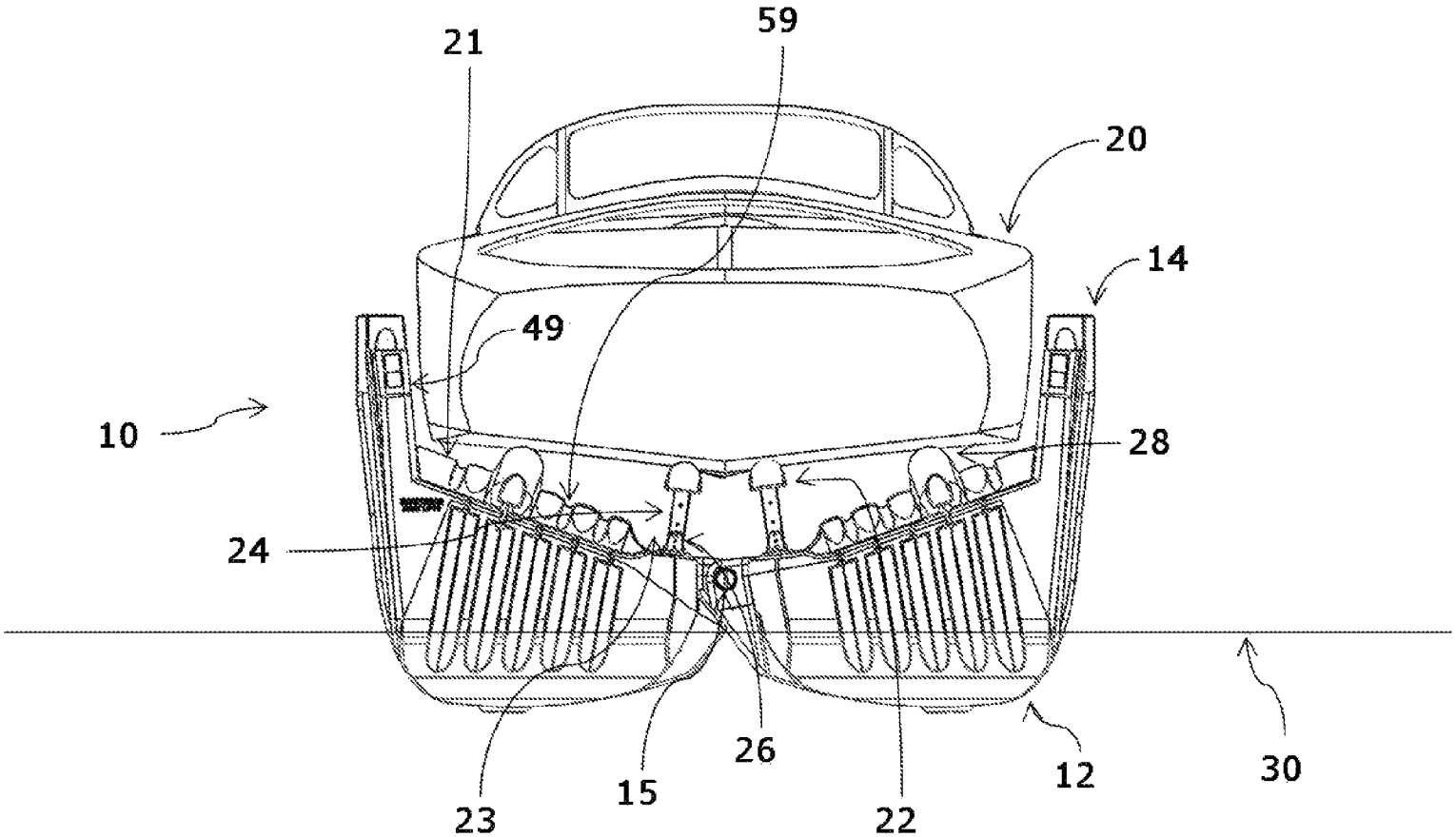
Figure 3:
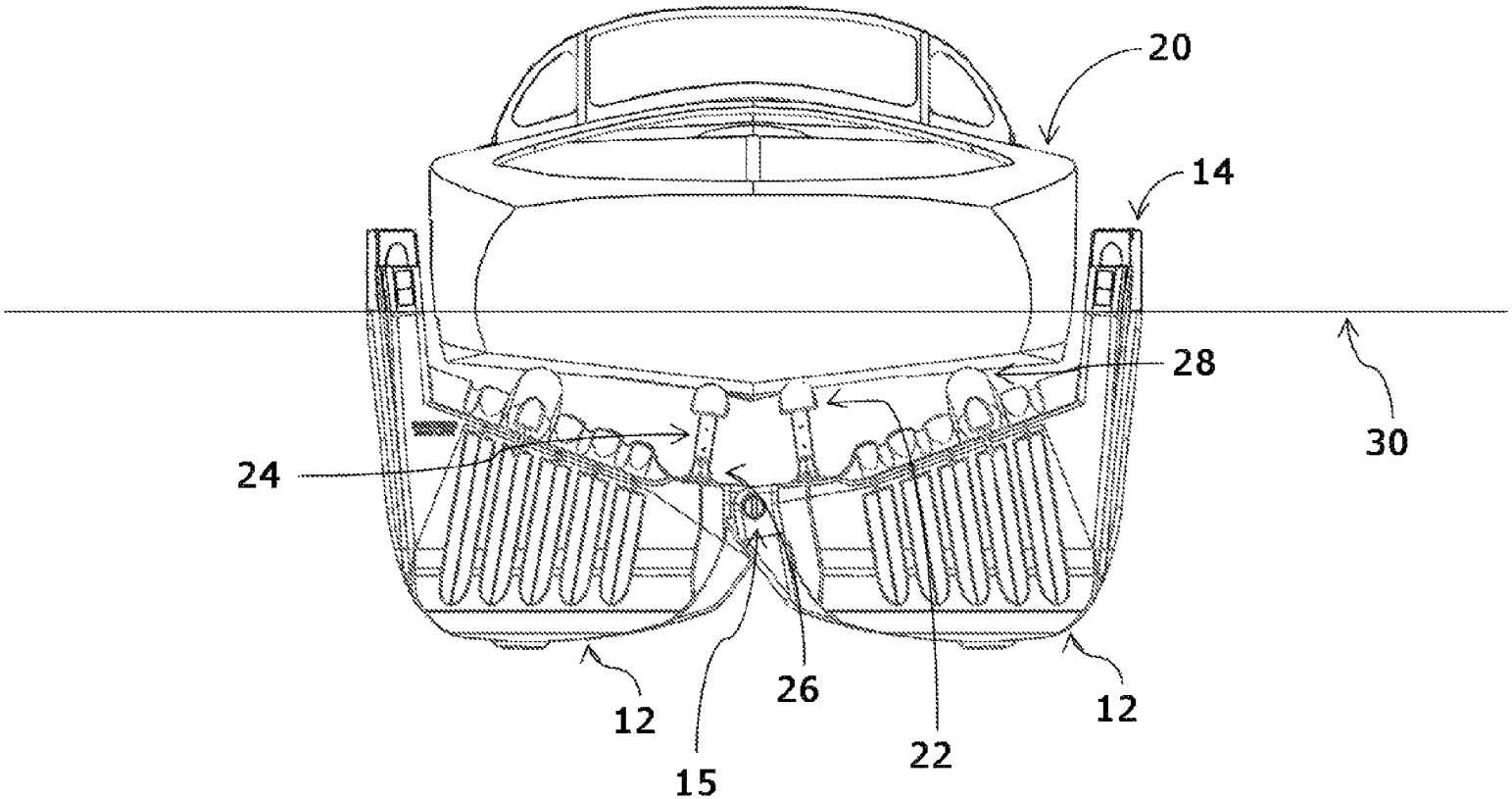
Figure 4:
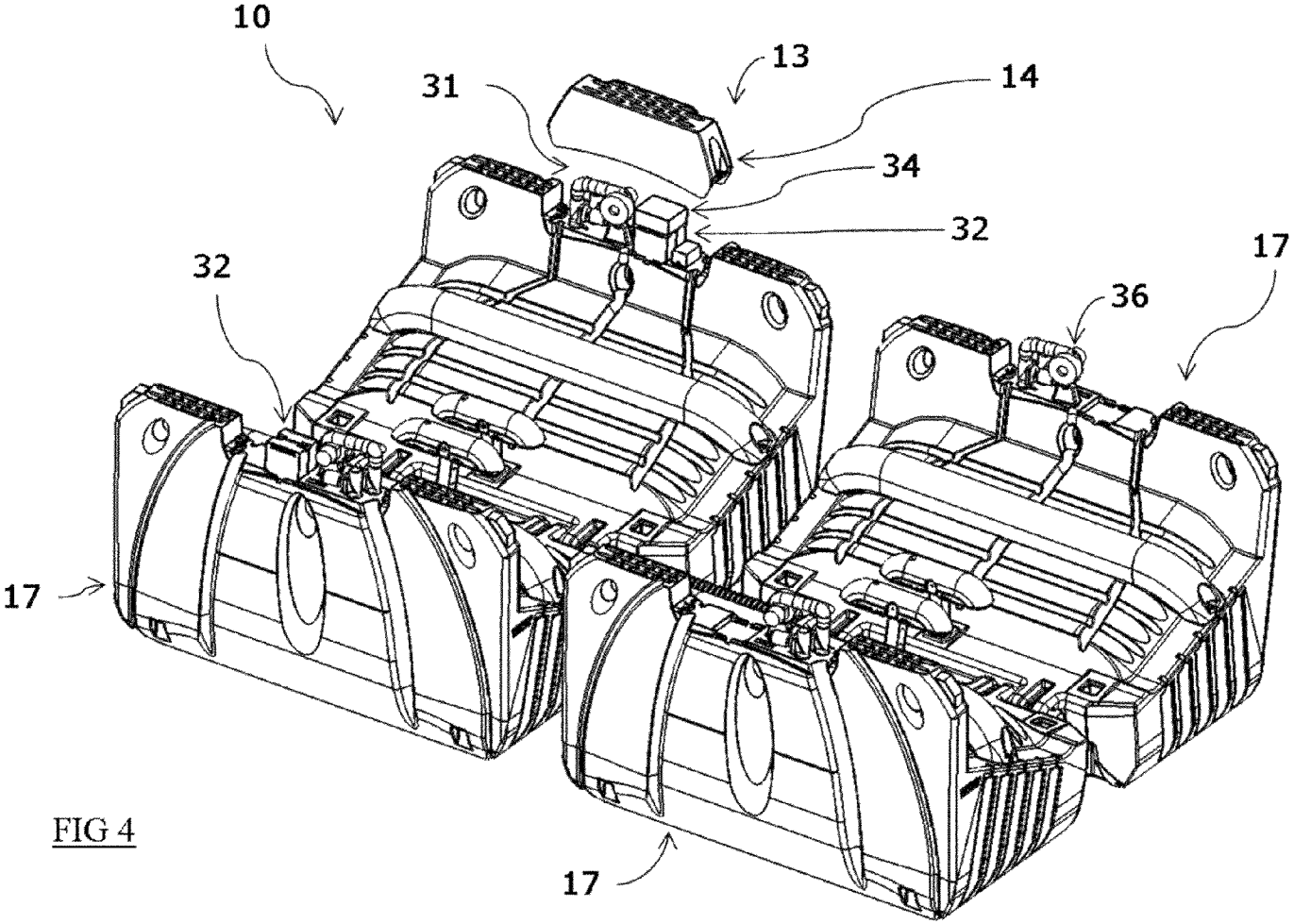
Figure 5:
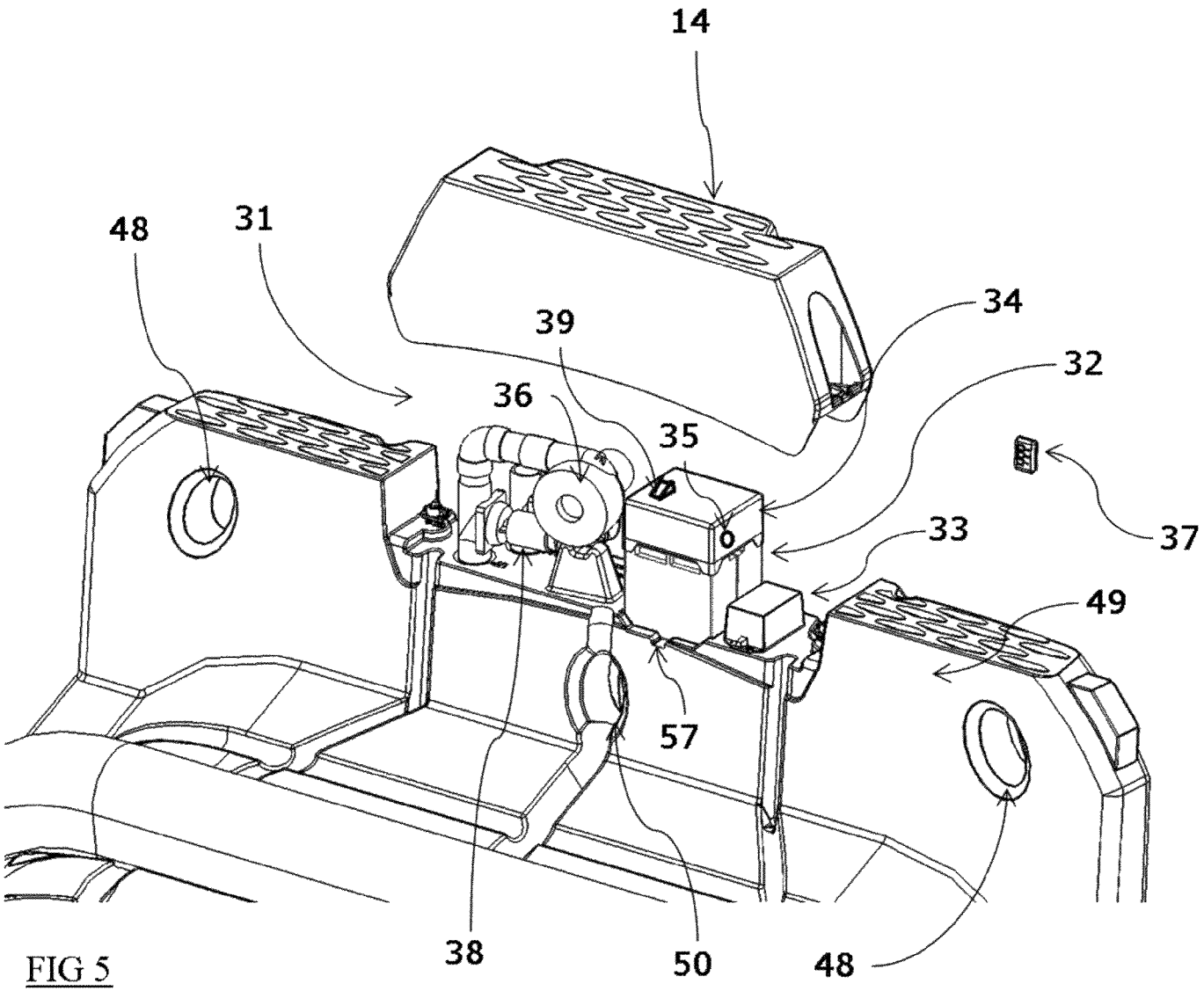
Figure 6:
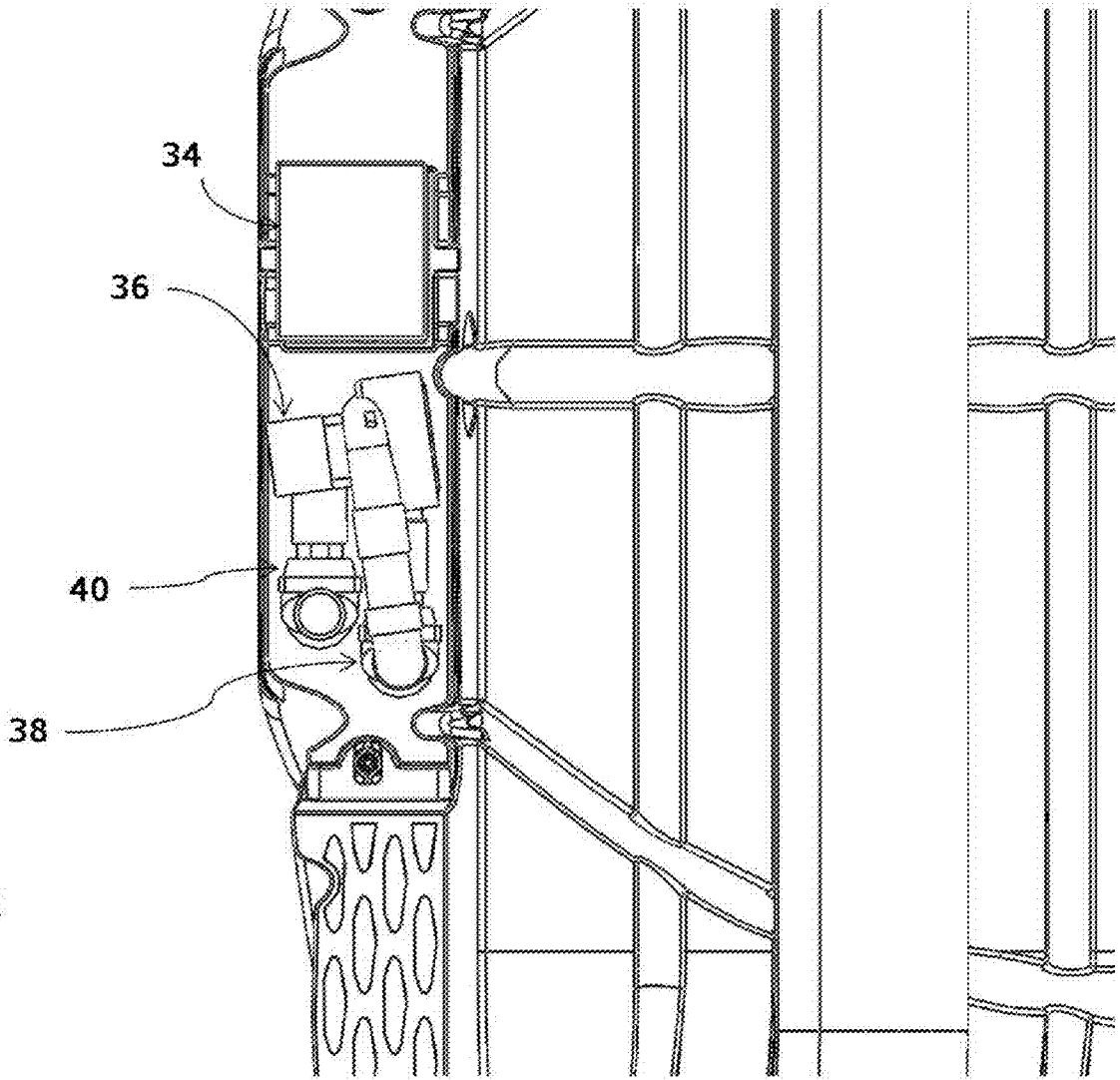
Figure 7:
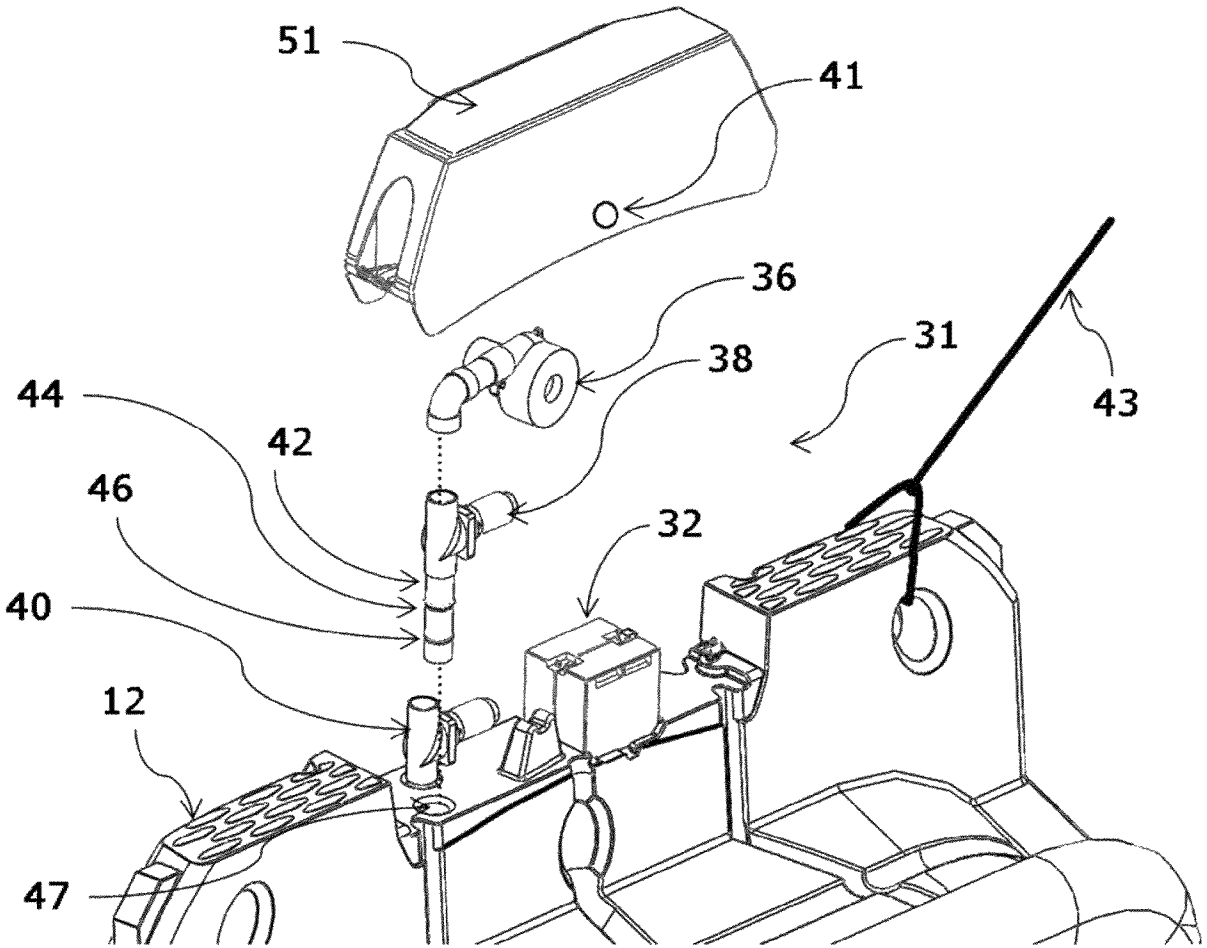
Figure 8:
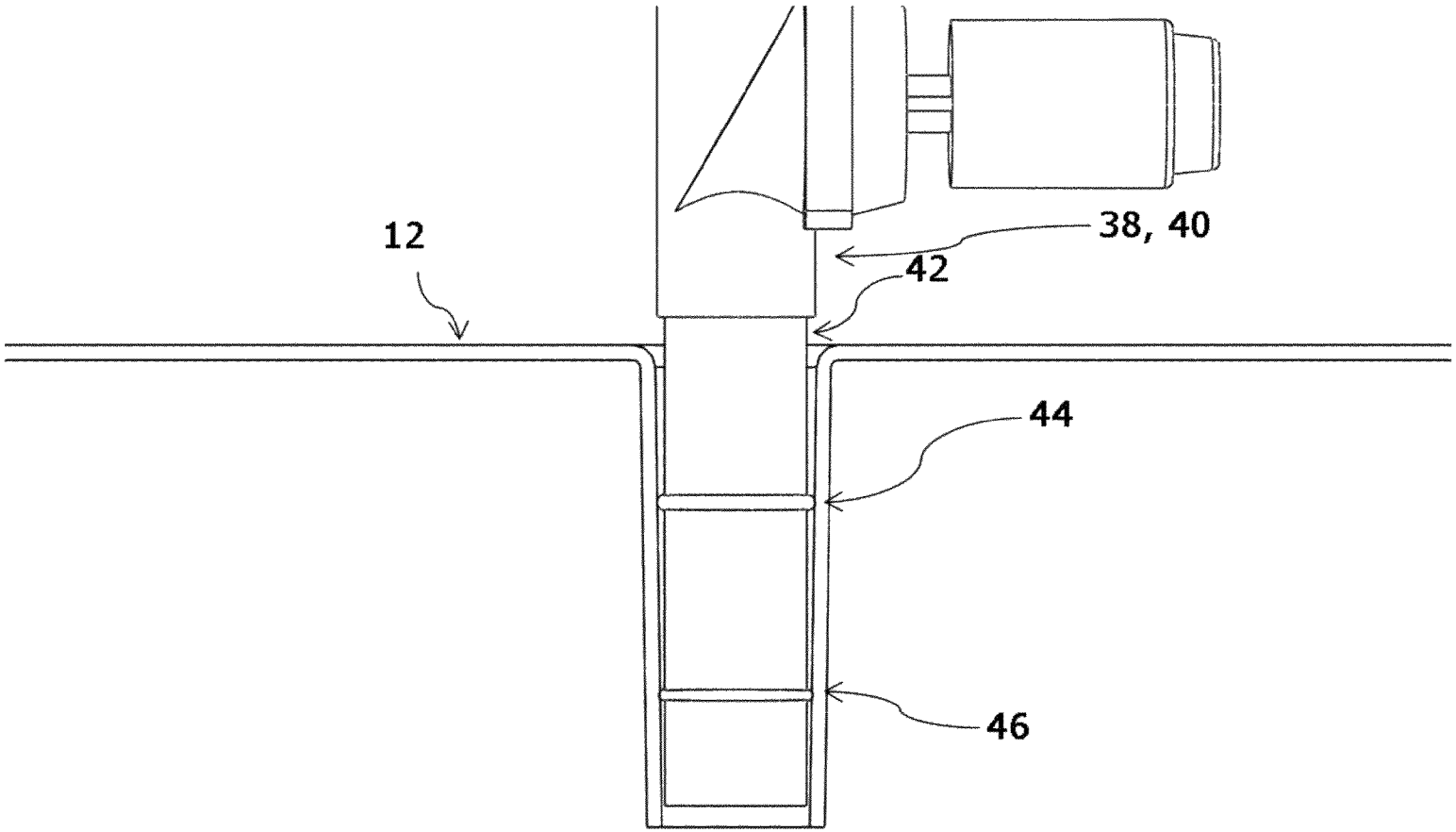
Figure 9:
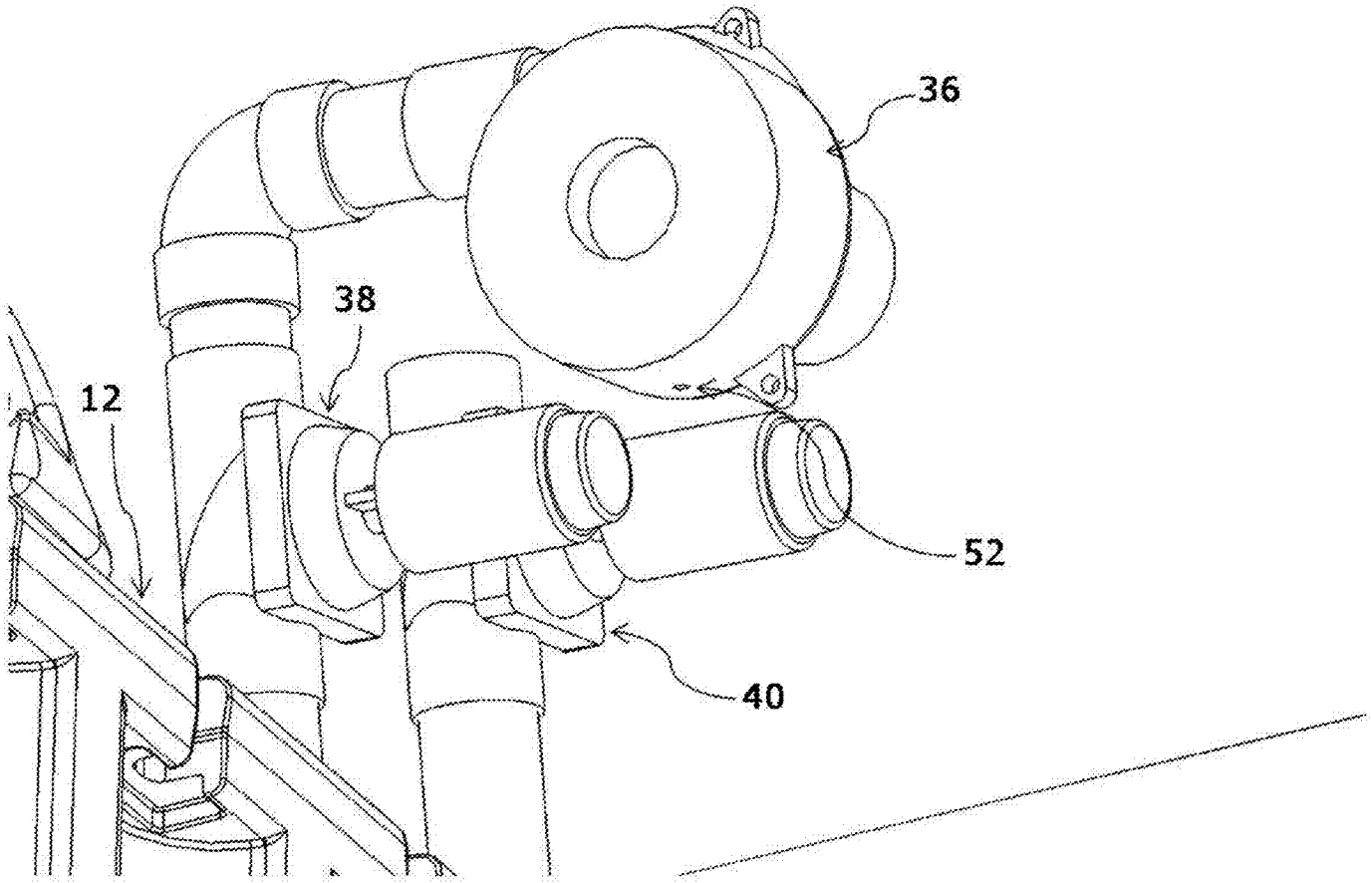
Figure 10:
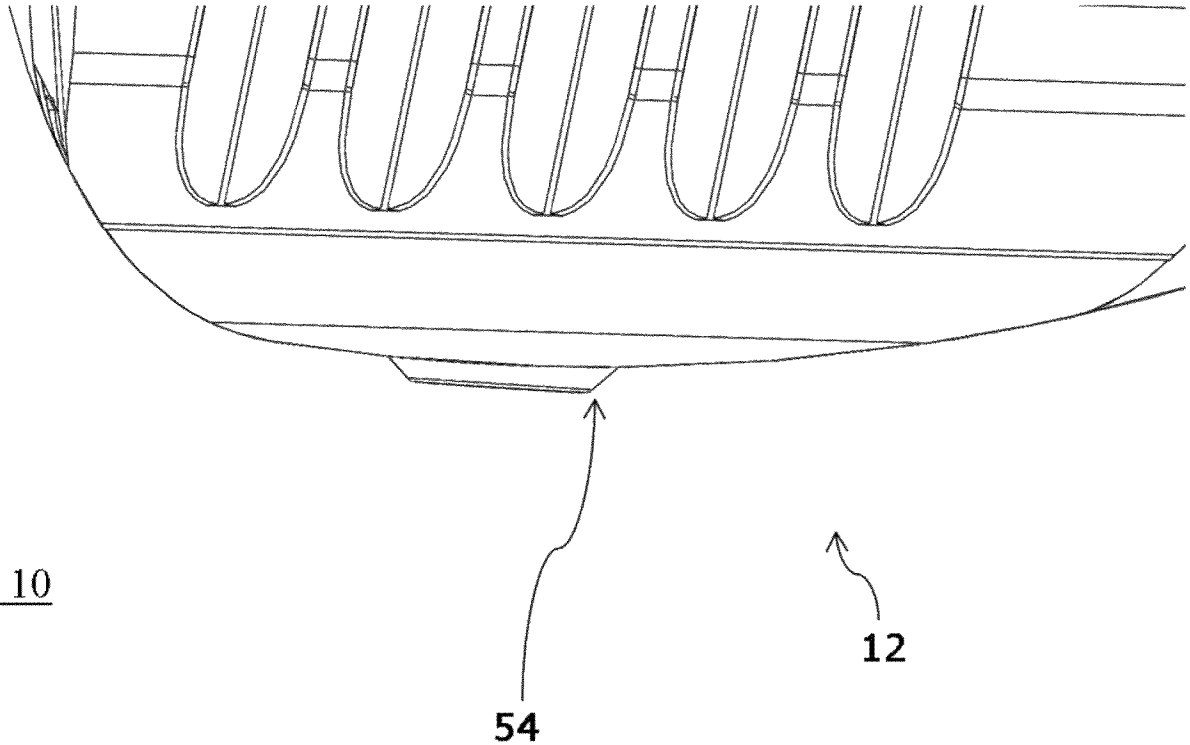
Figure 11:
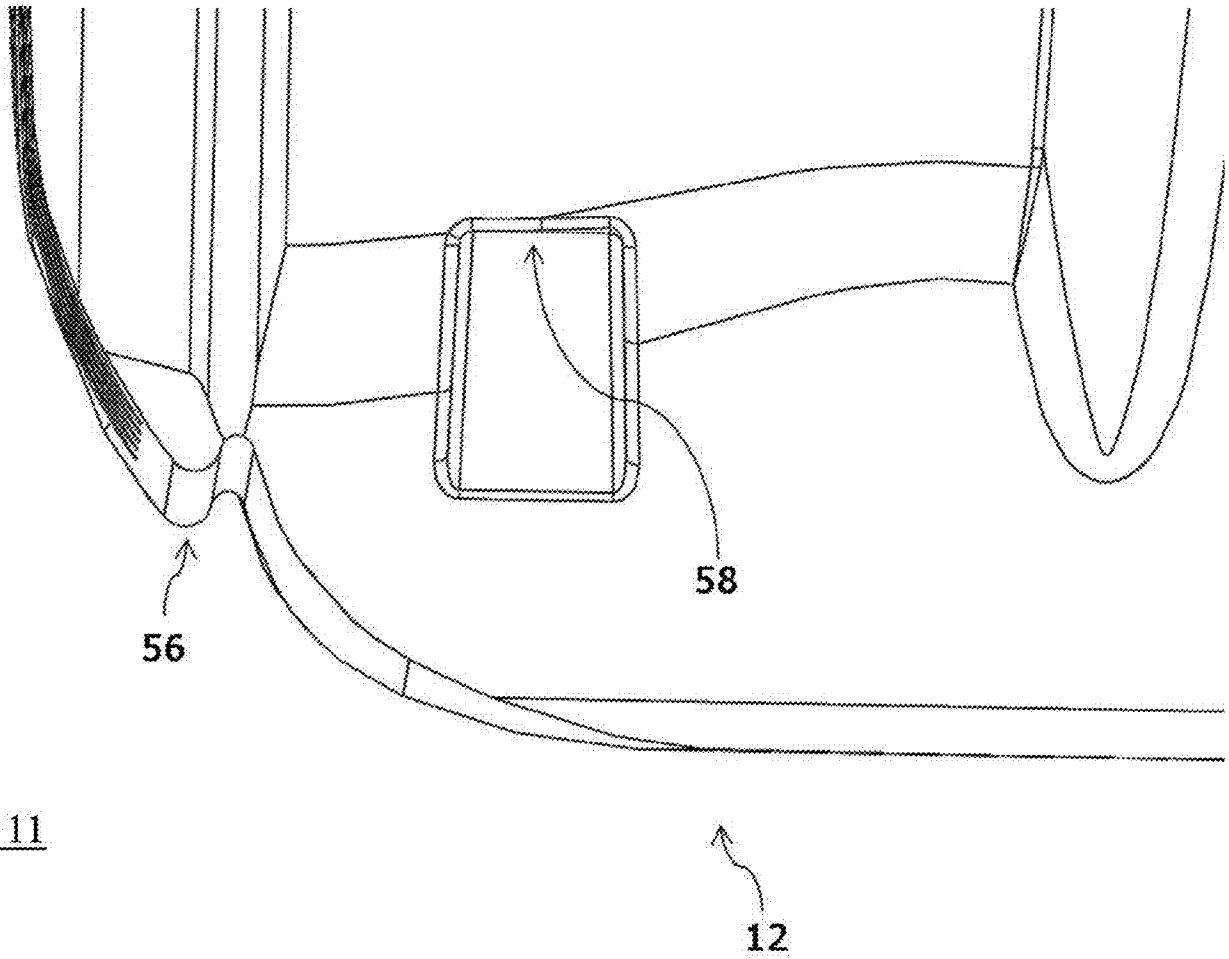
Figure 12:
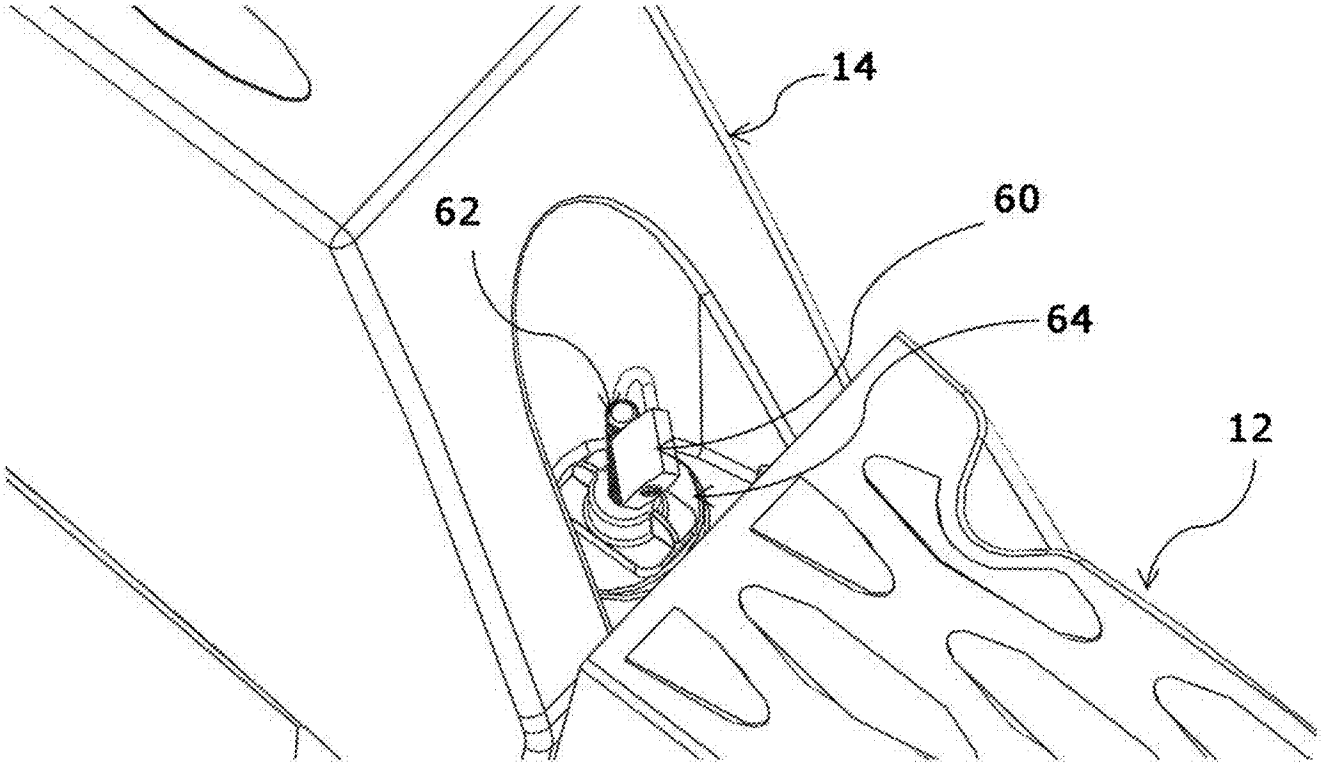
Figure 13:
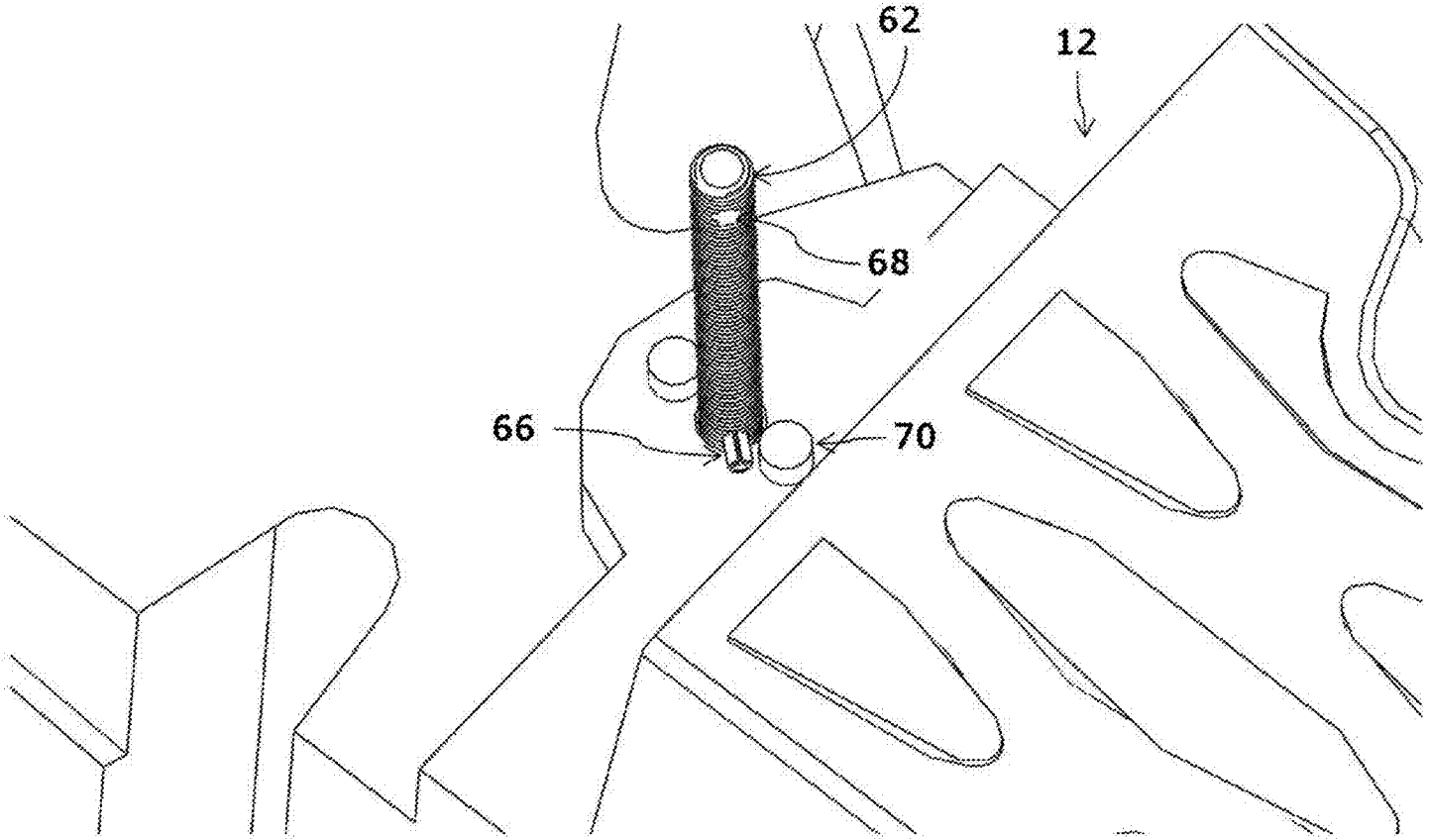
Figure 14:
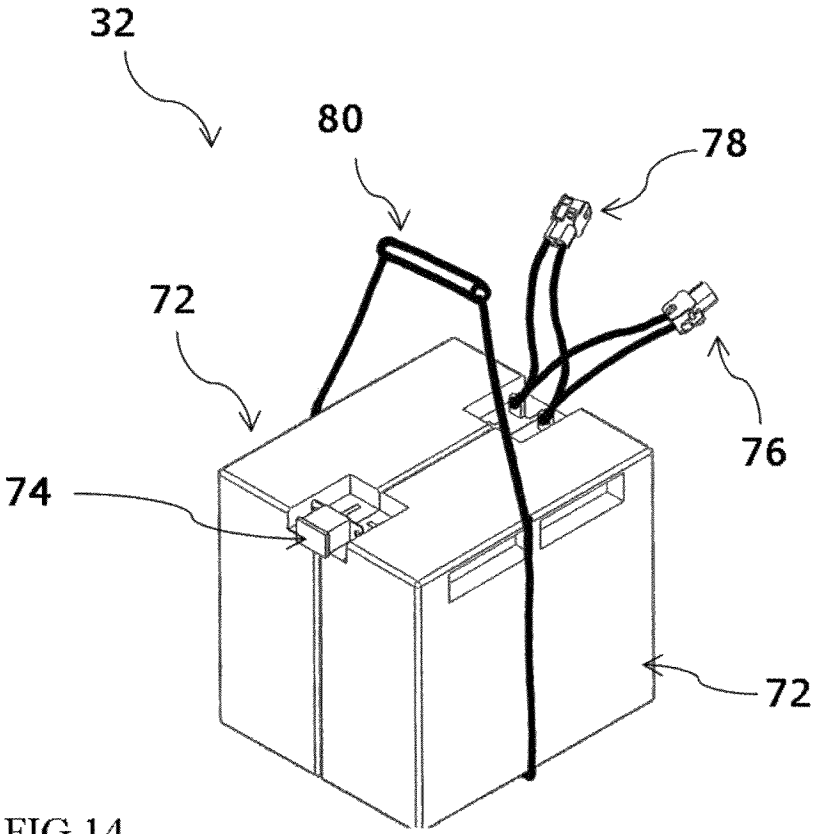
Figure 15:
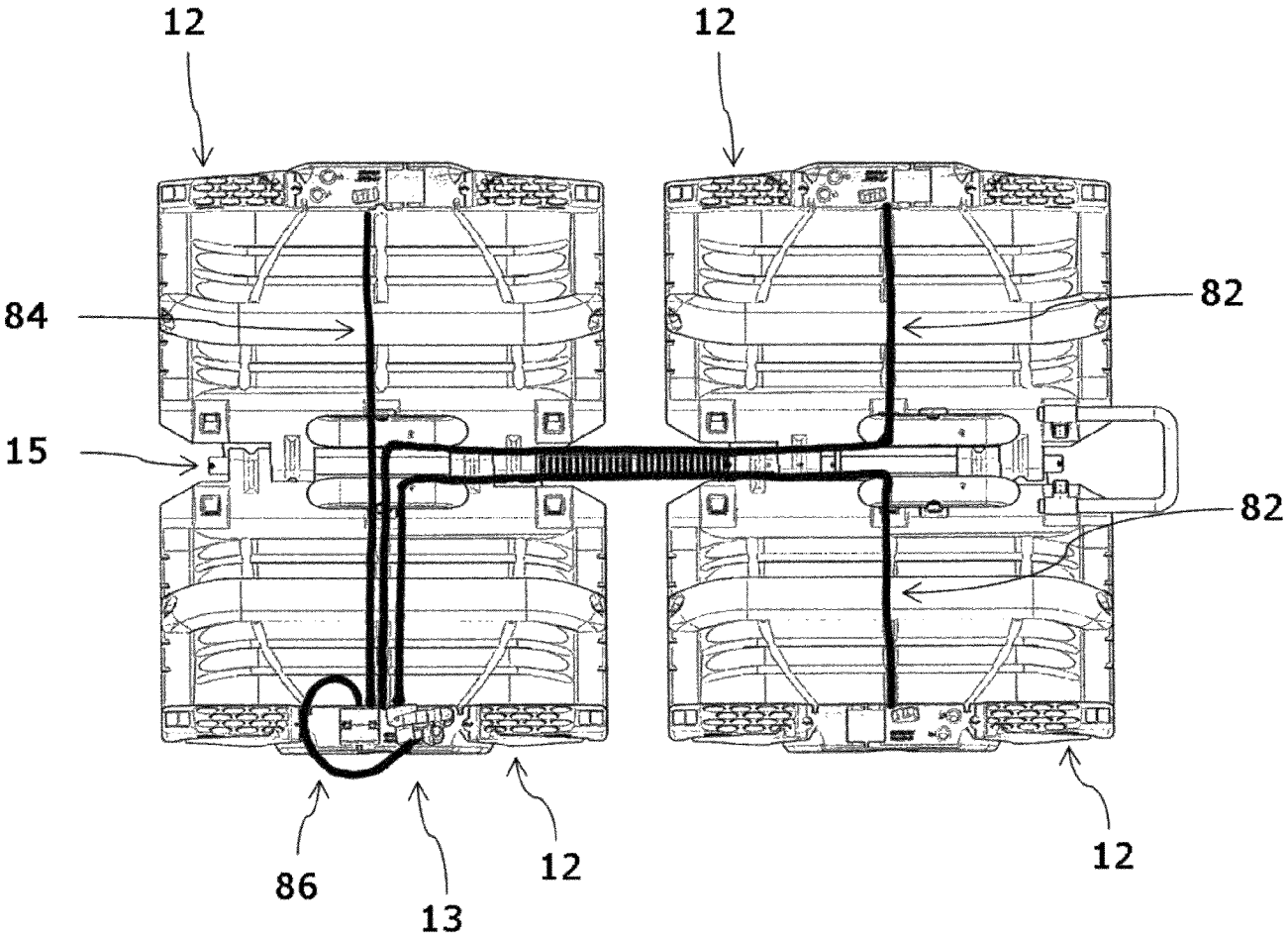
Figure 16:
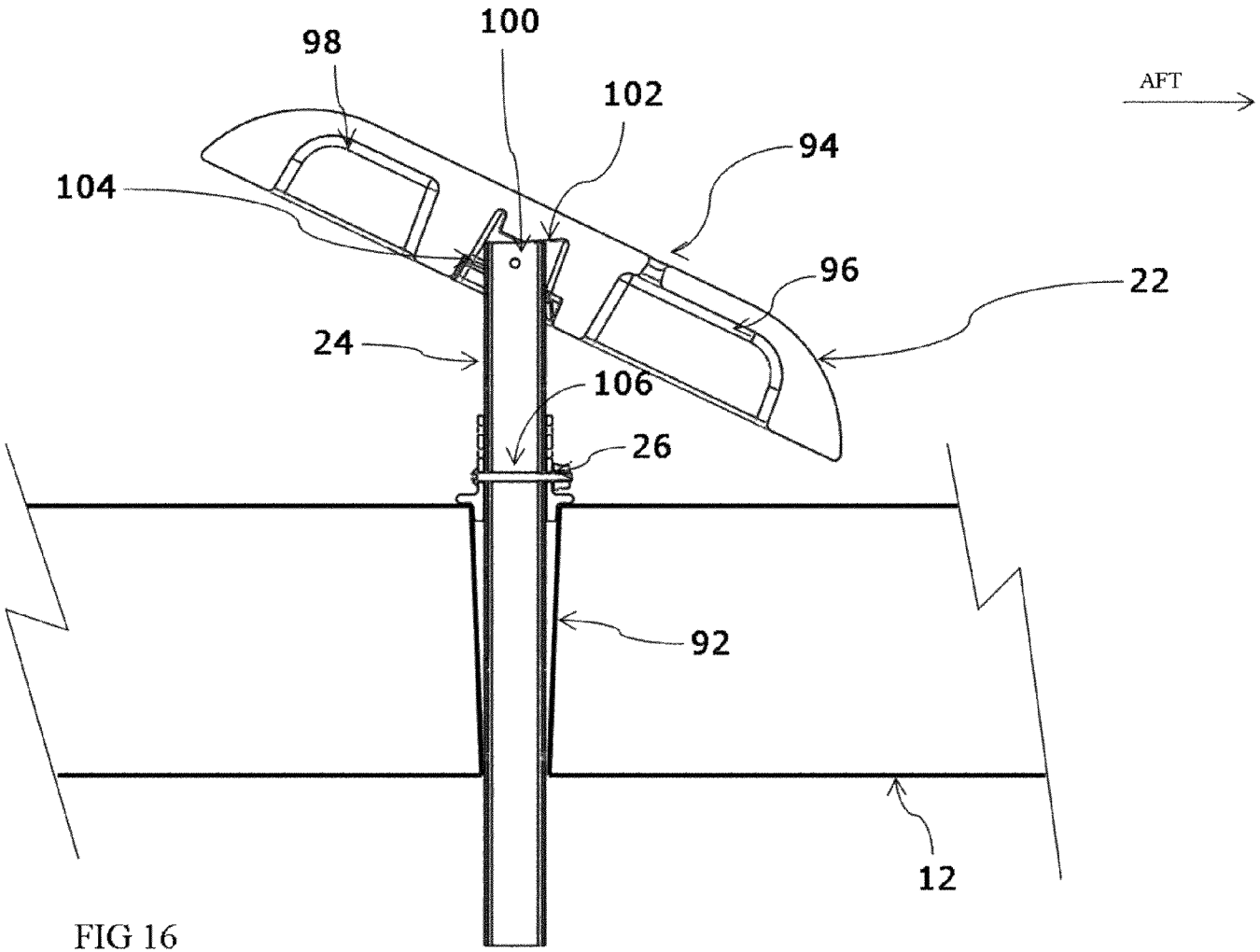
Figure 17:
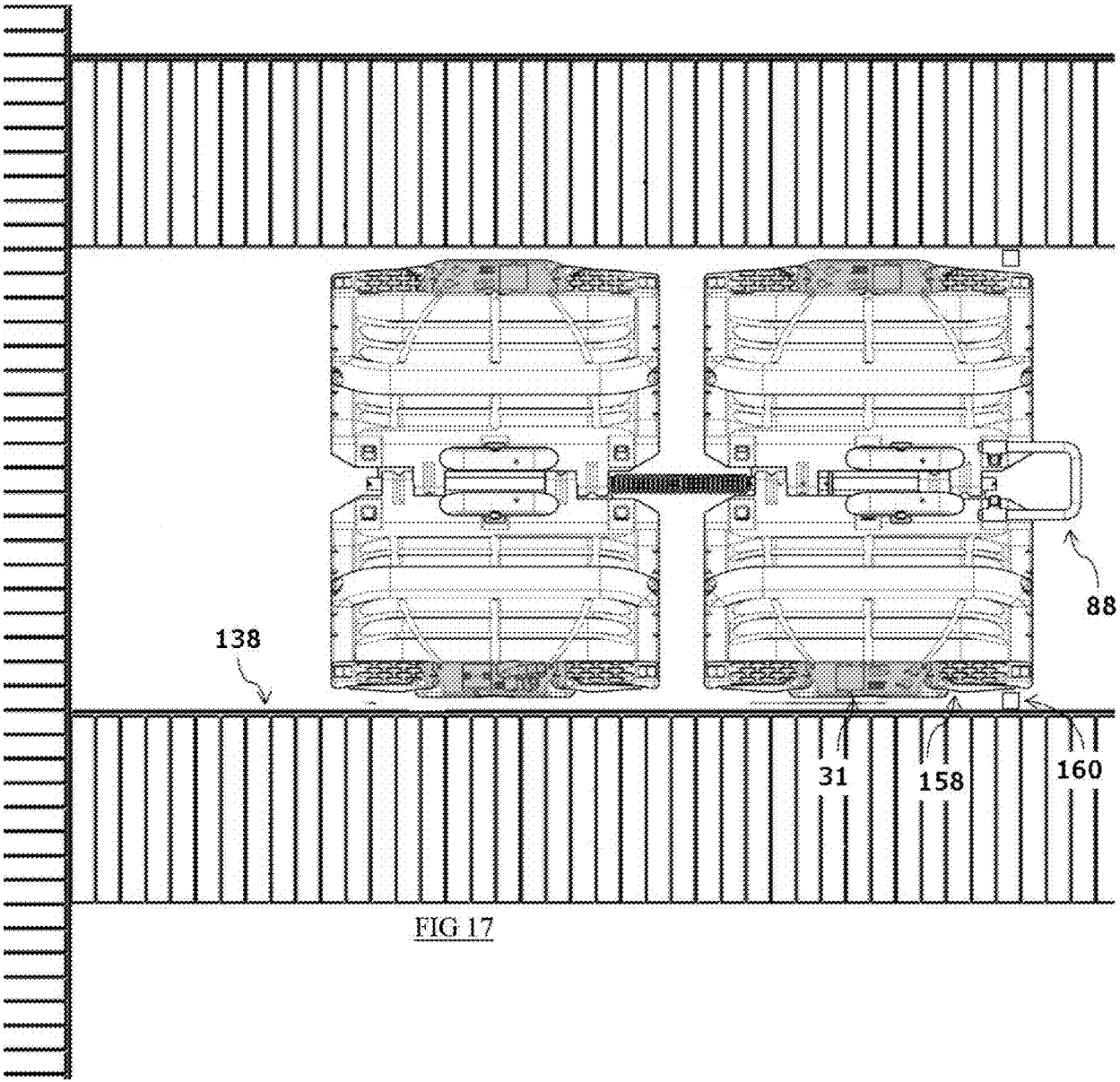
Figure 18:
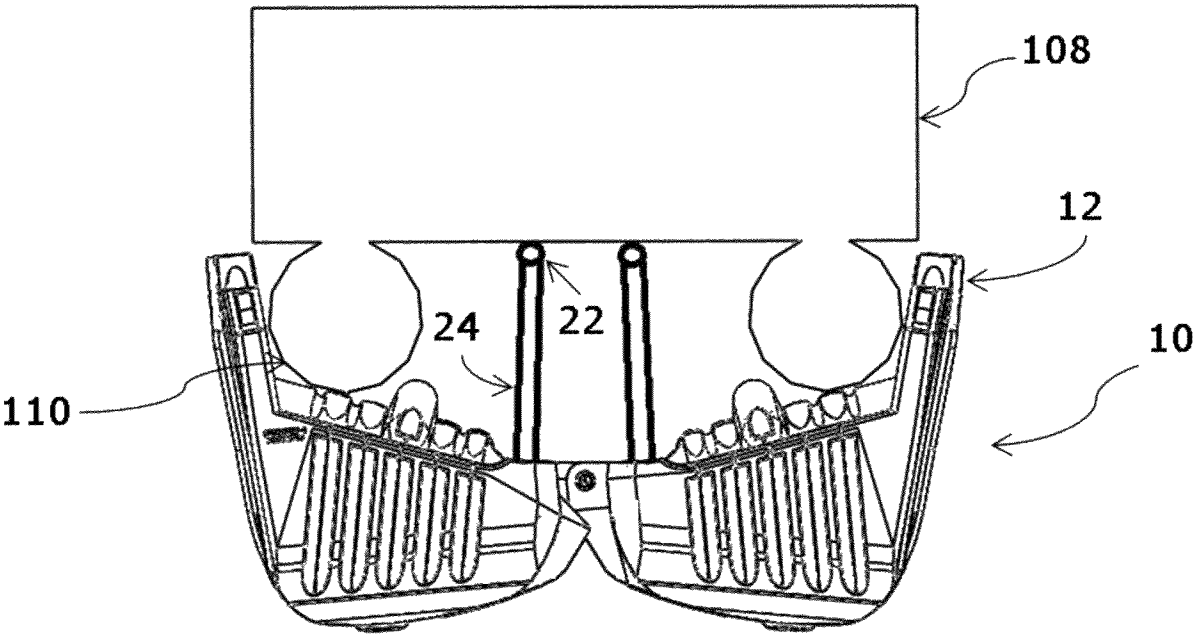
Figure 19:
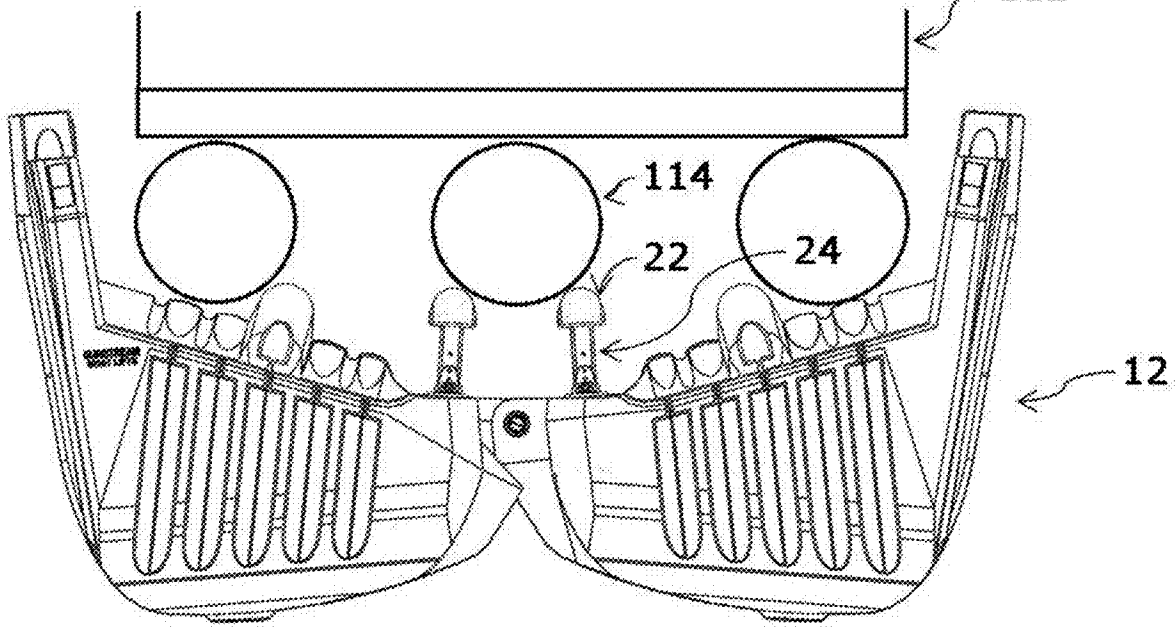
Figure 20:
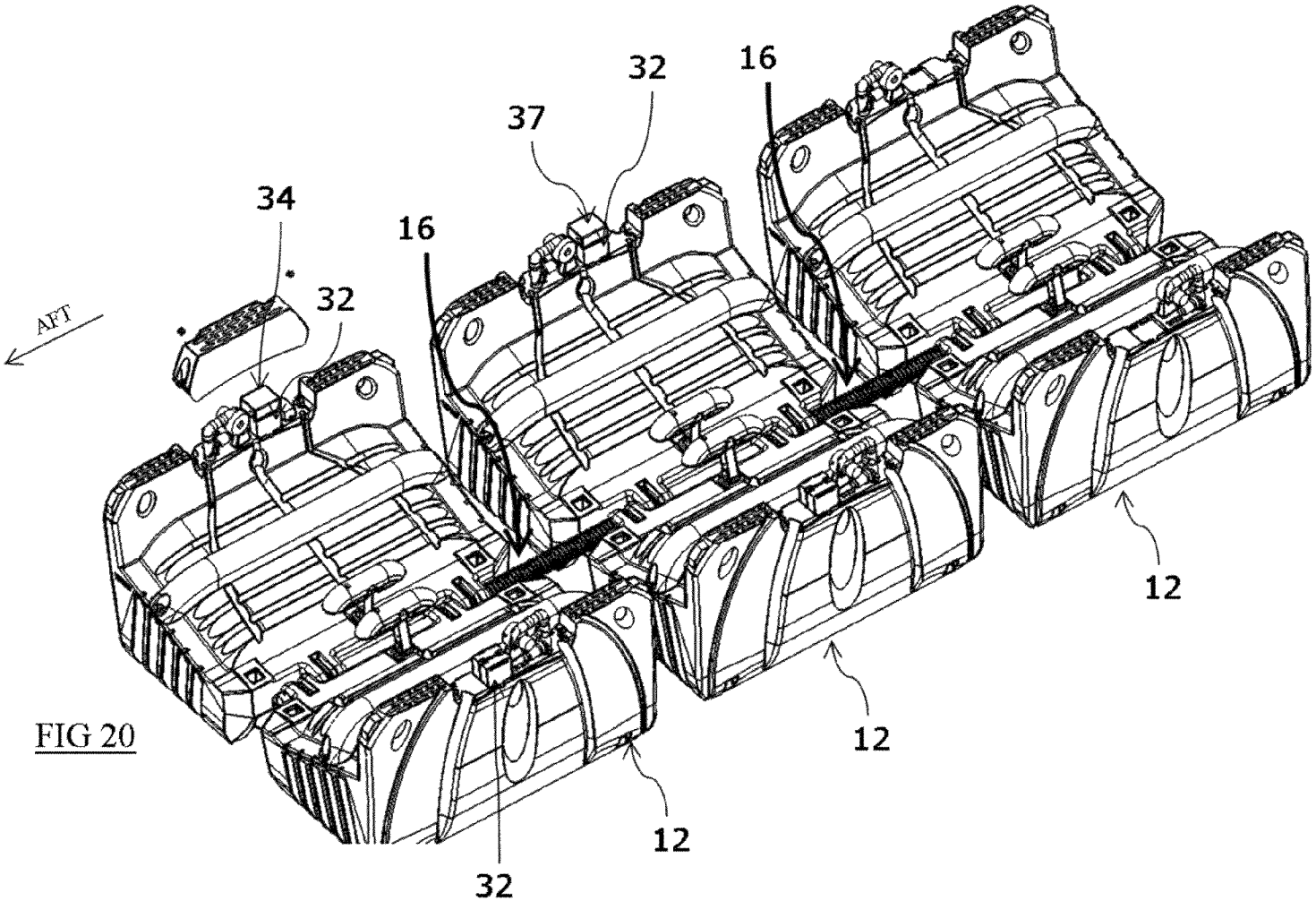
Figure 21:
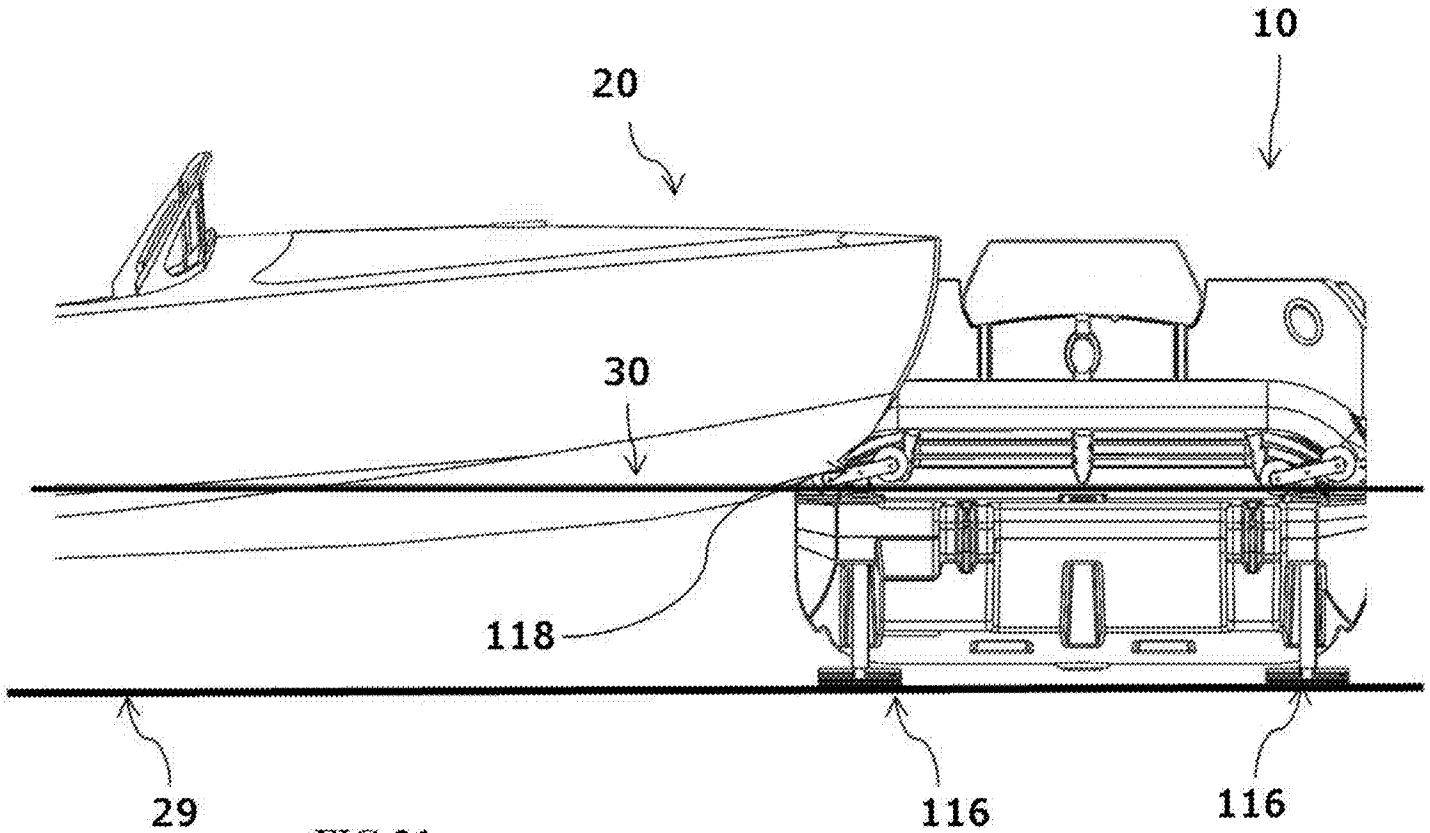
Figure 22:
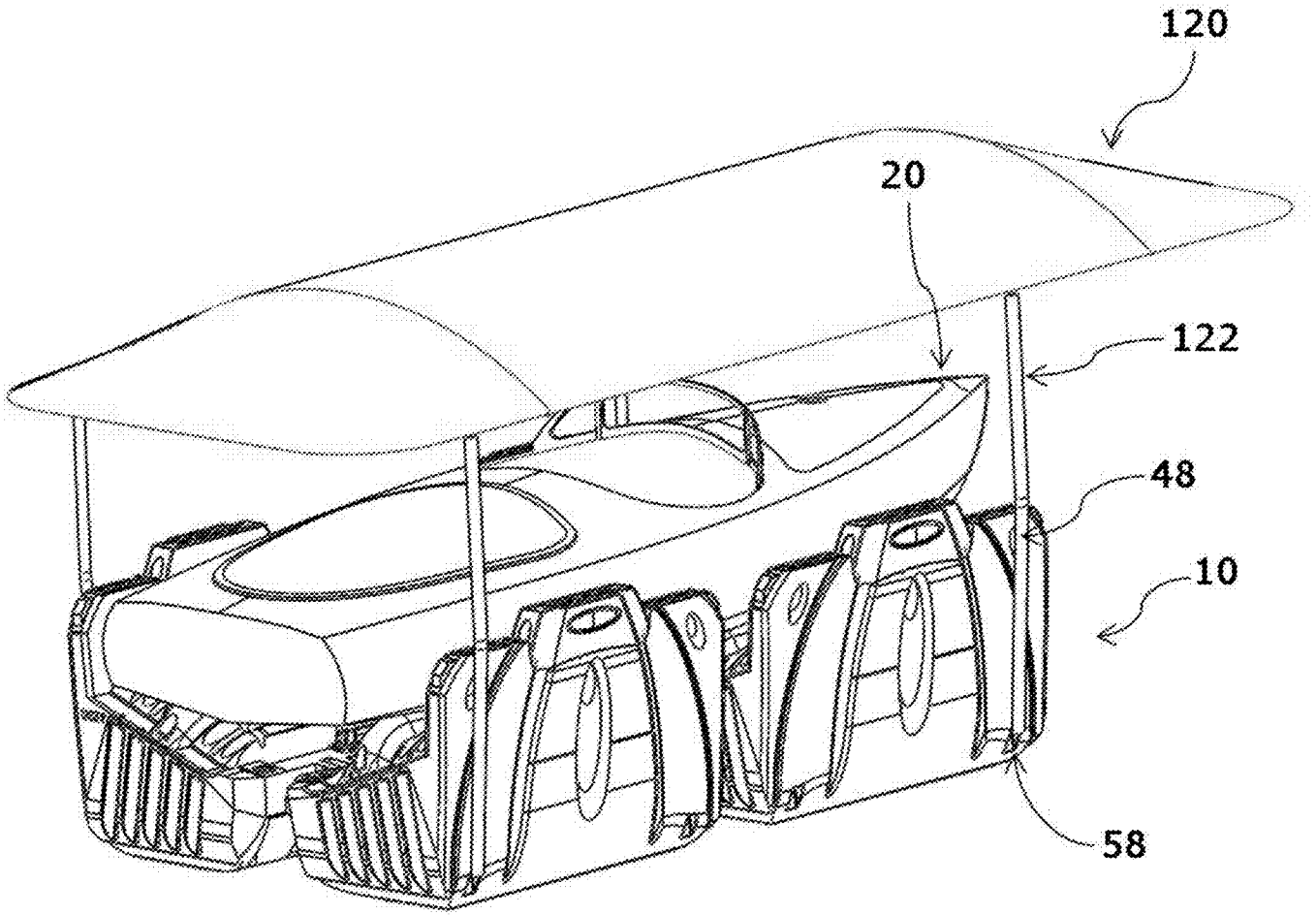
Figure 23:
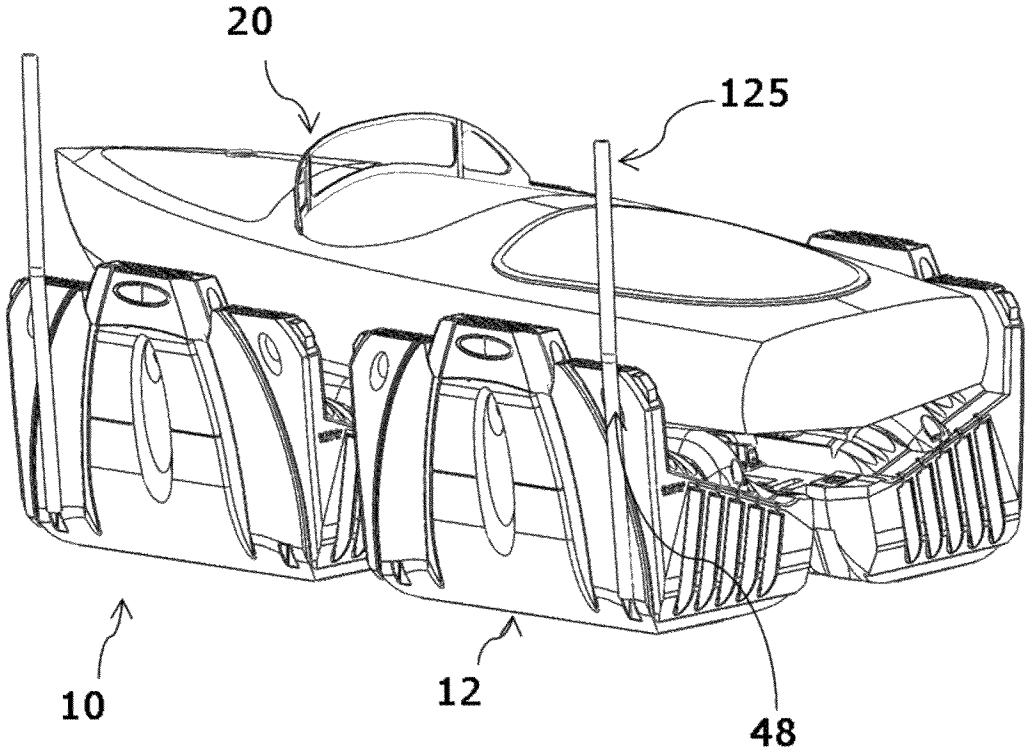
Figure 24:
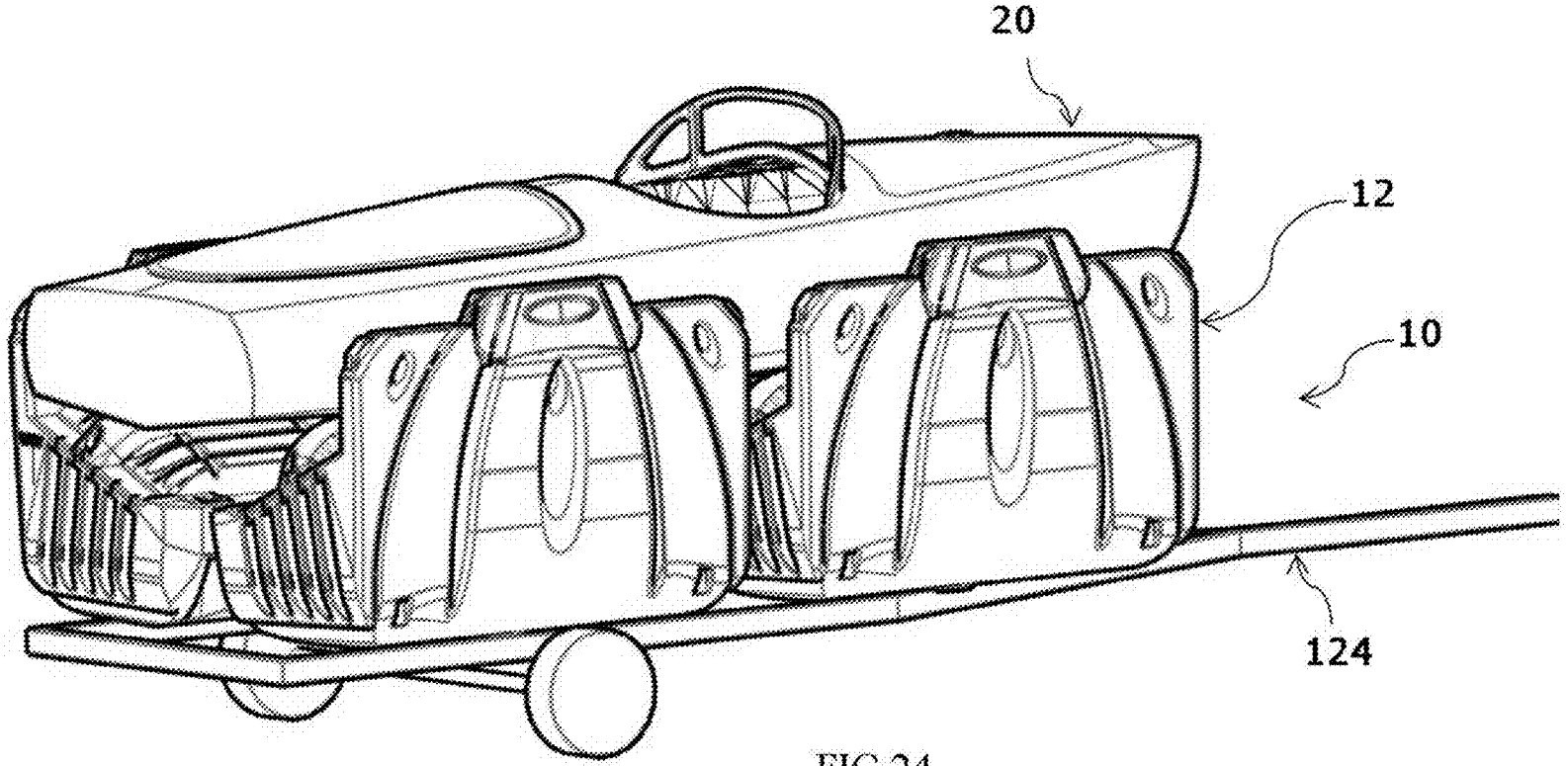
Figure 25:
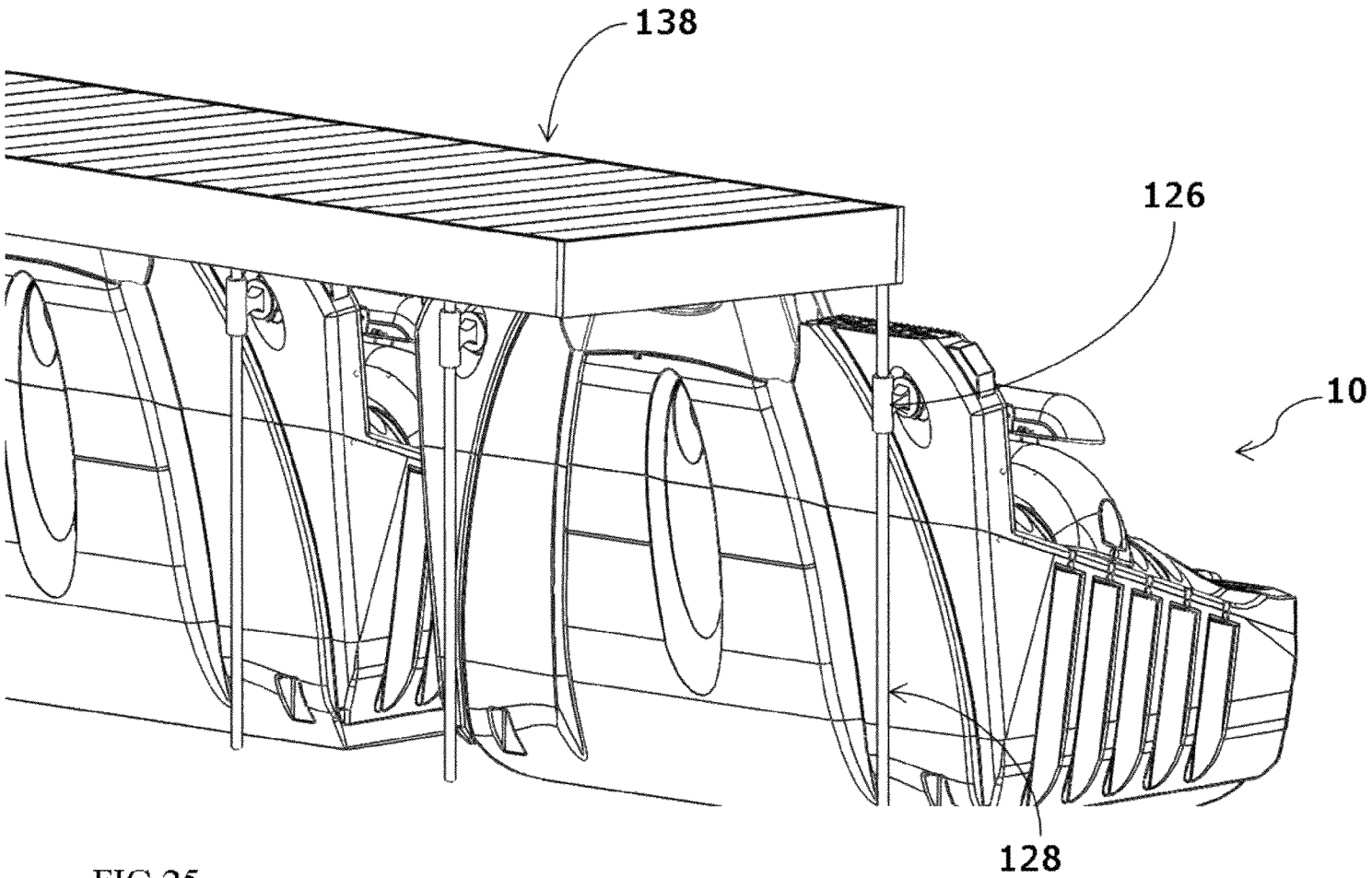
Figure 26:
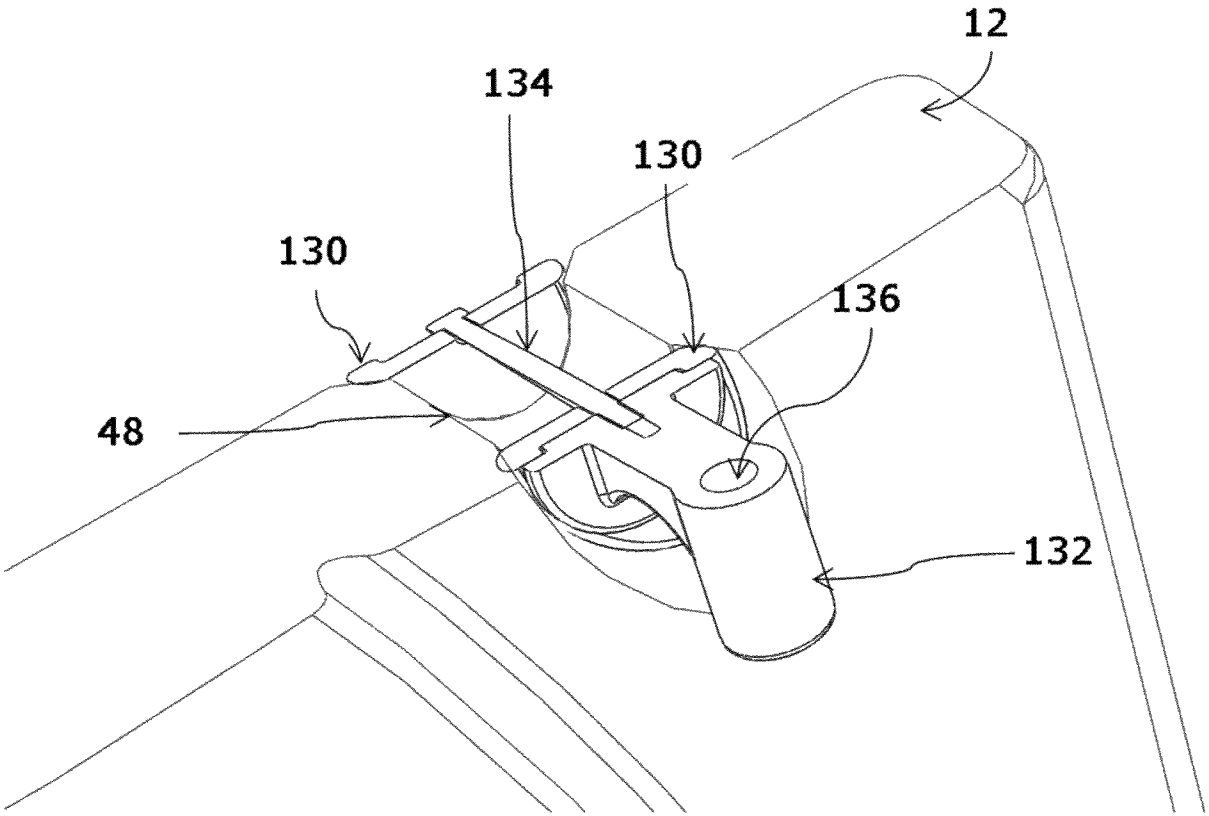
Figure 27:
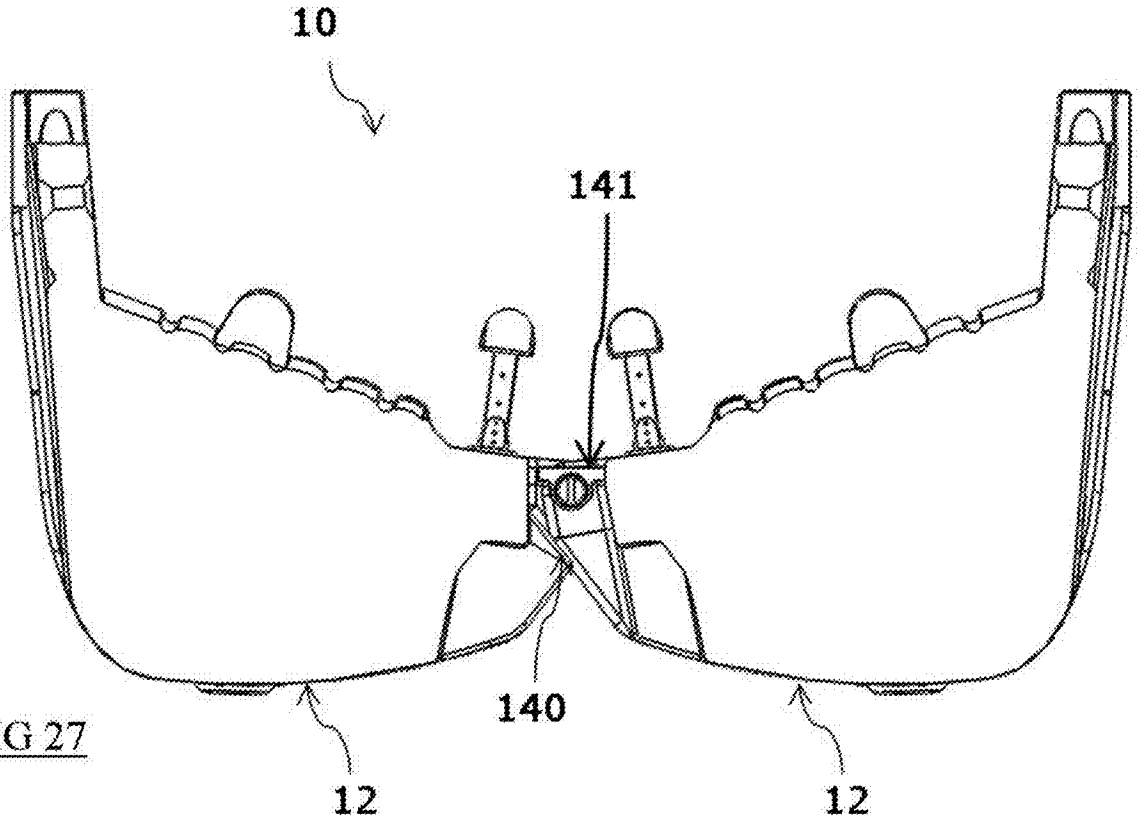
Figure 28:
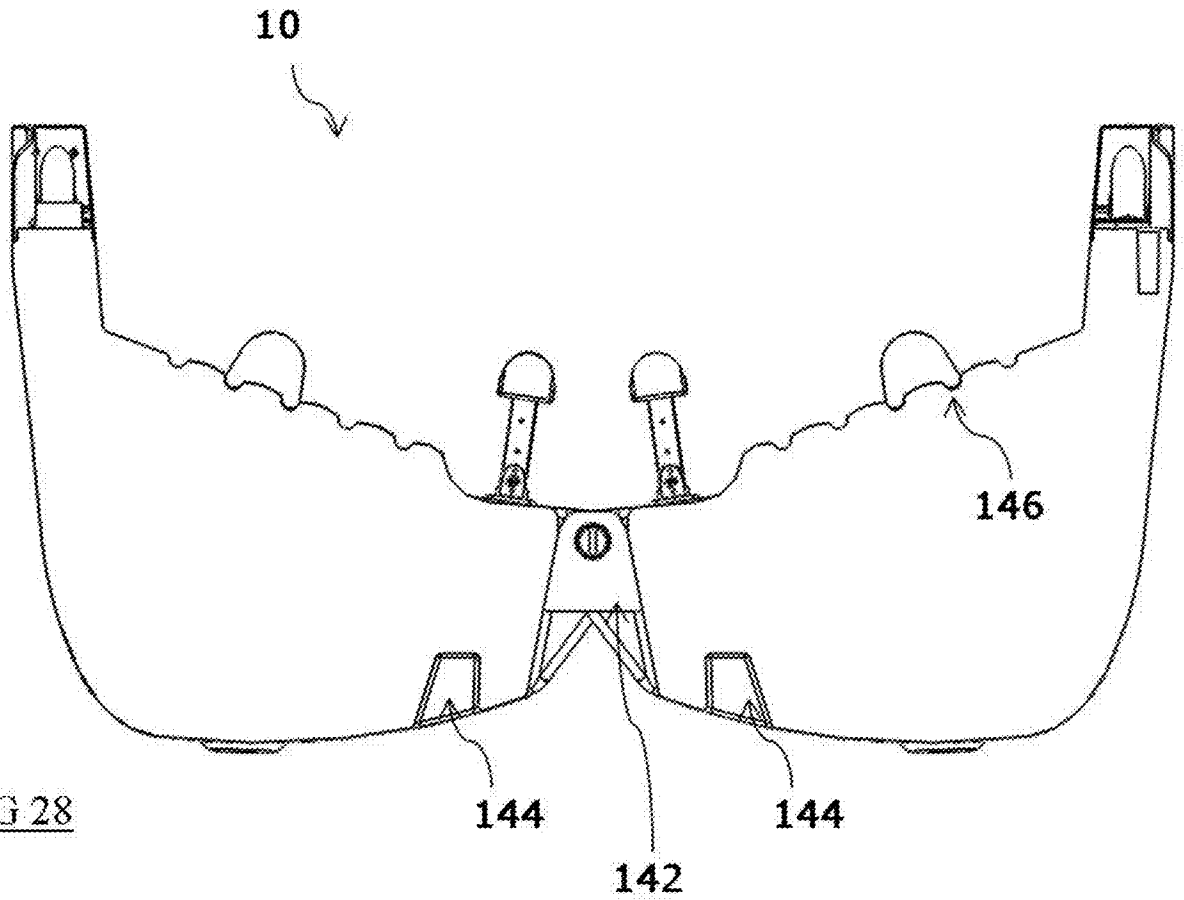
Figure 29:
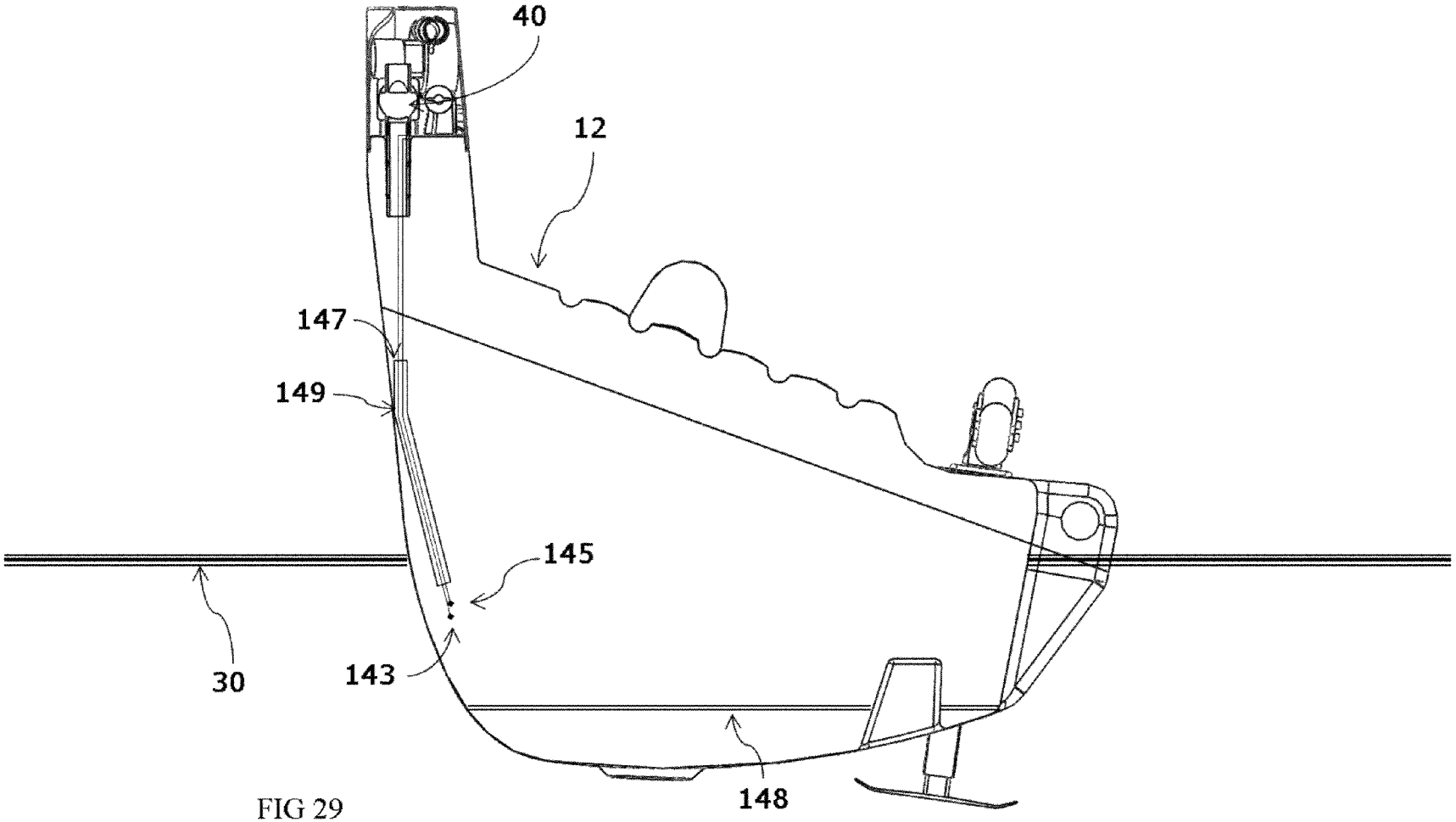
Figure 30:
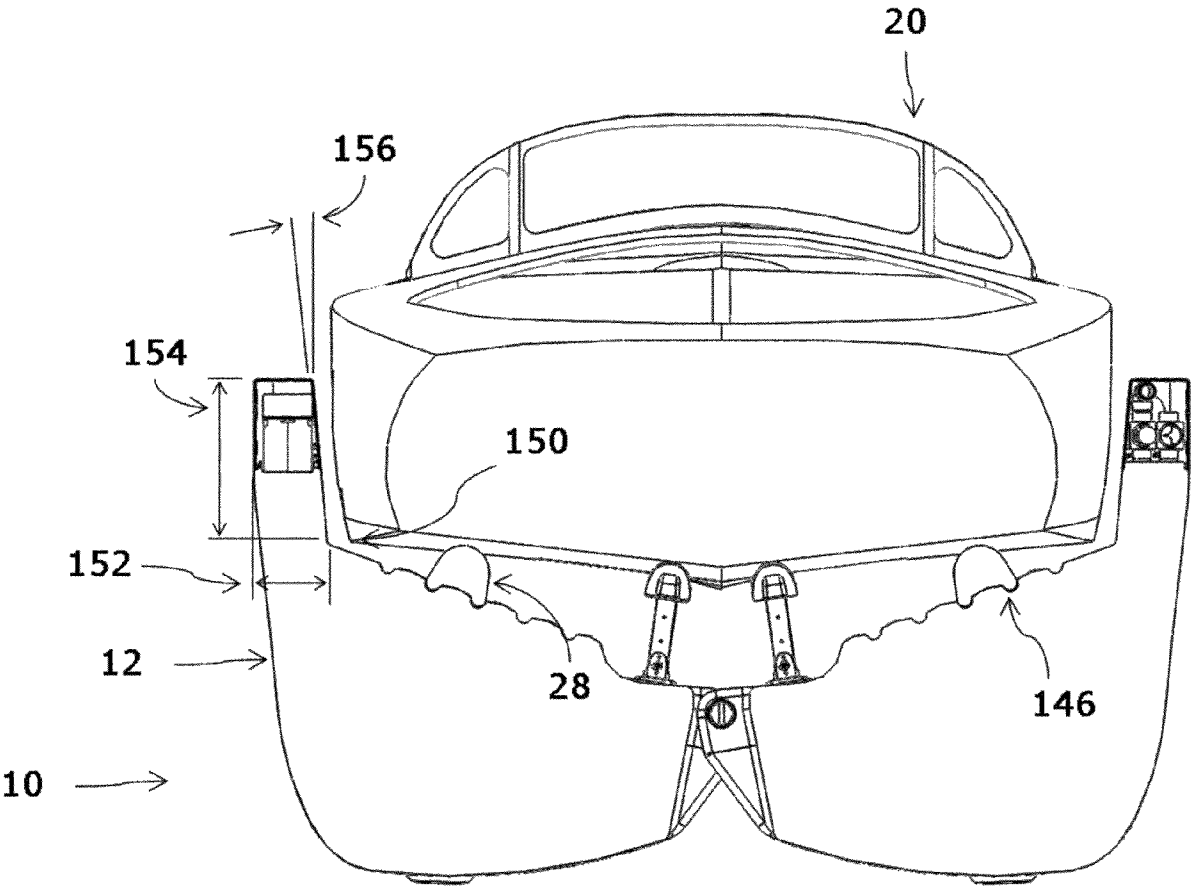
Figure 31:
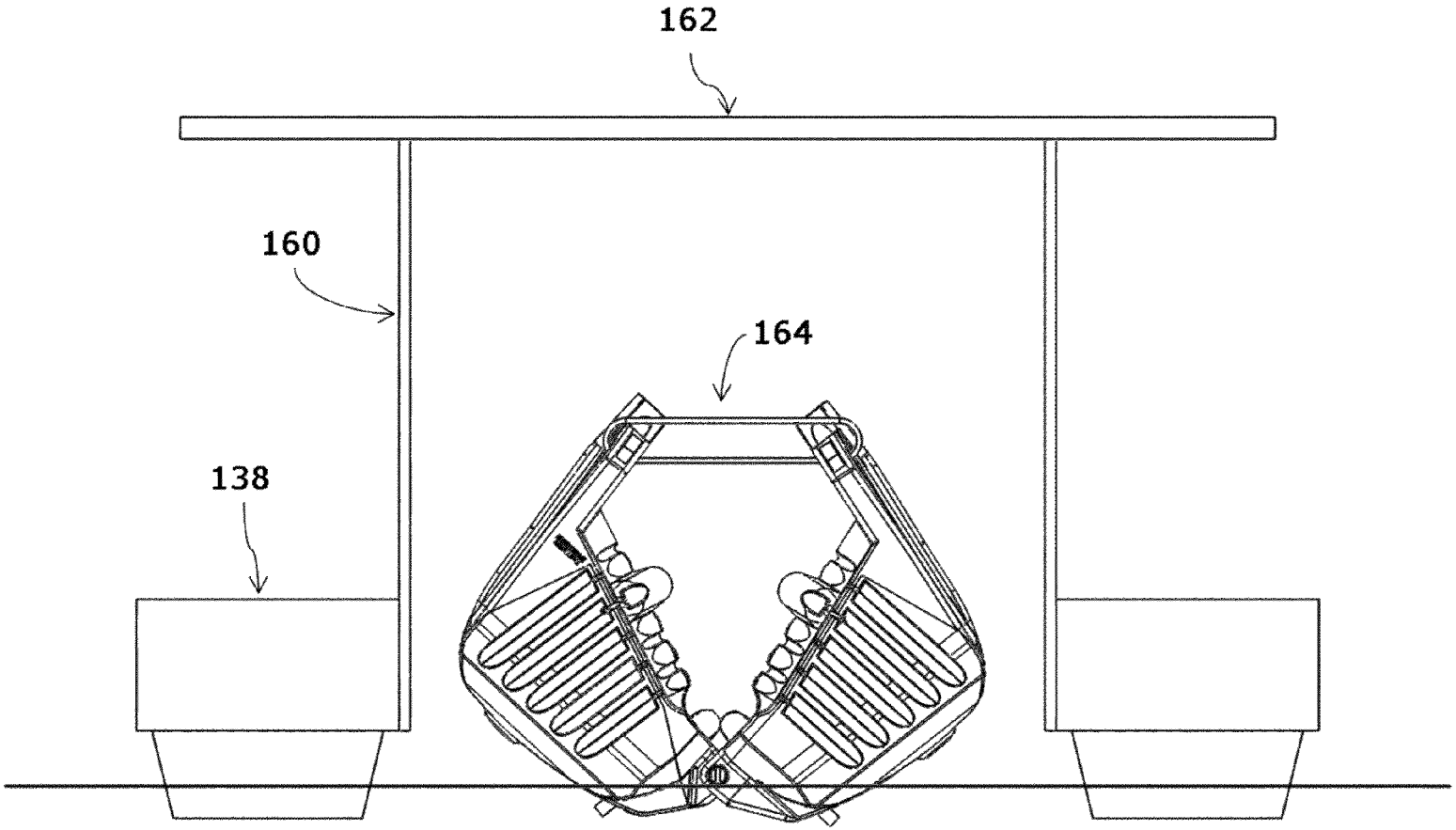
Figure 32:
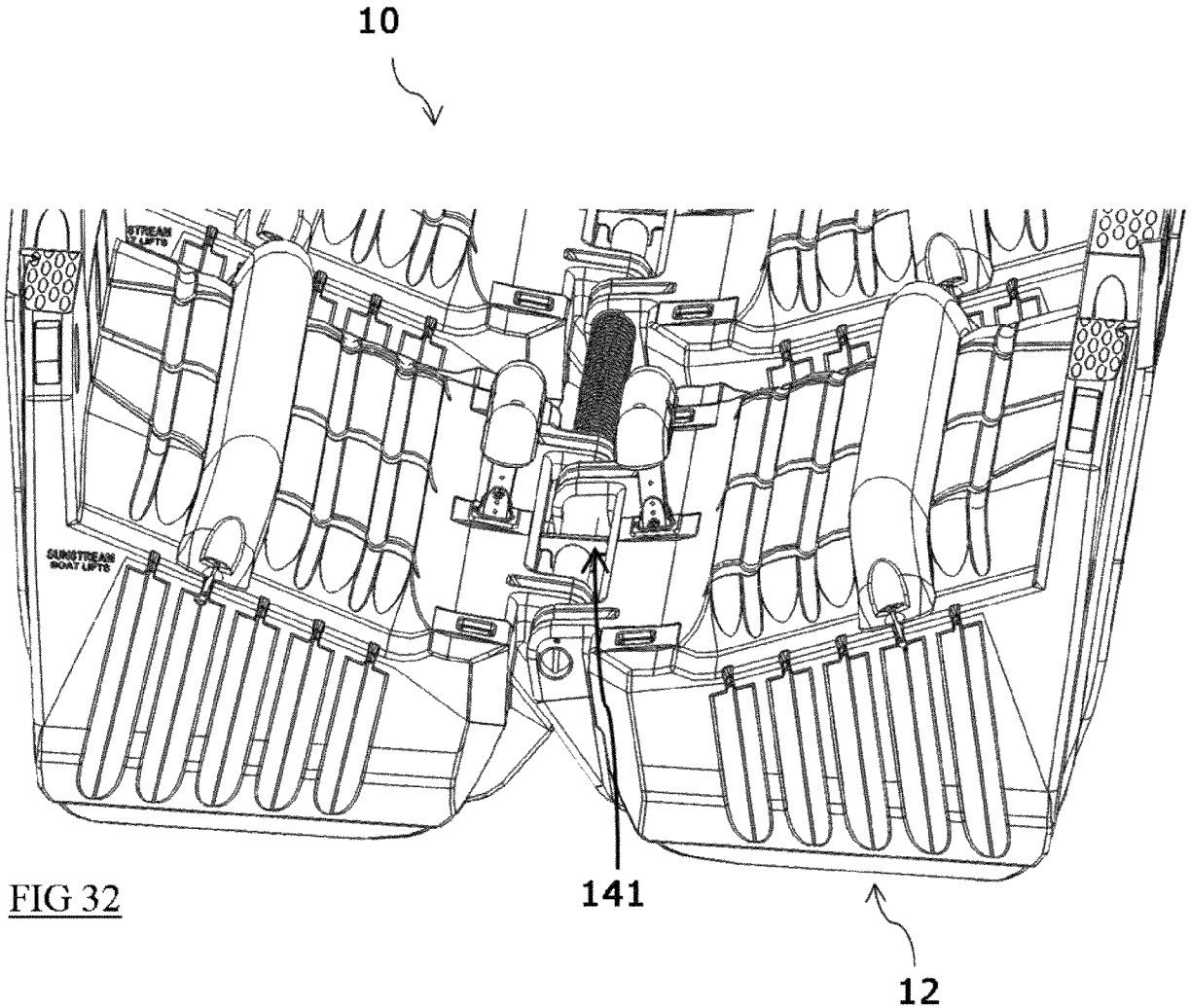
Figure 33:
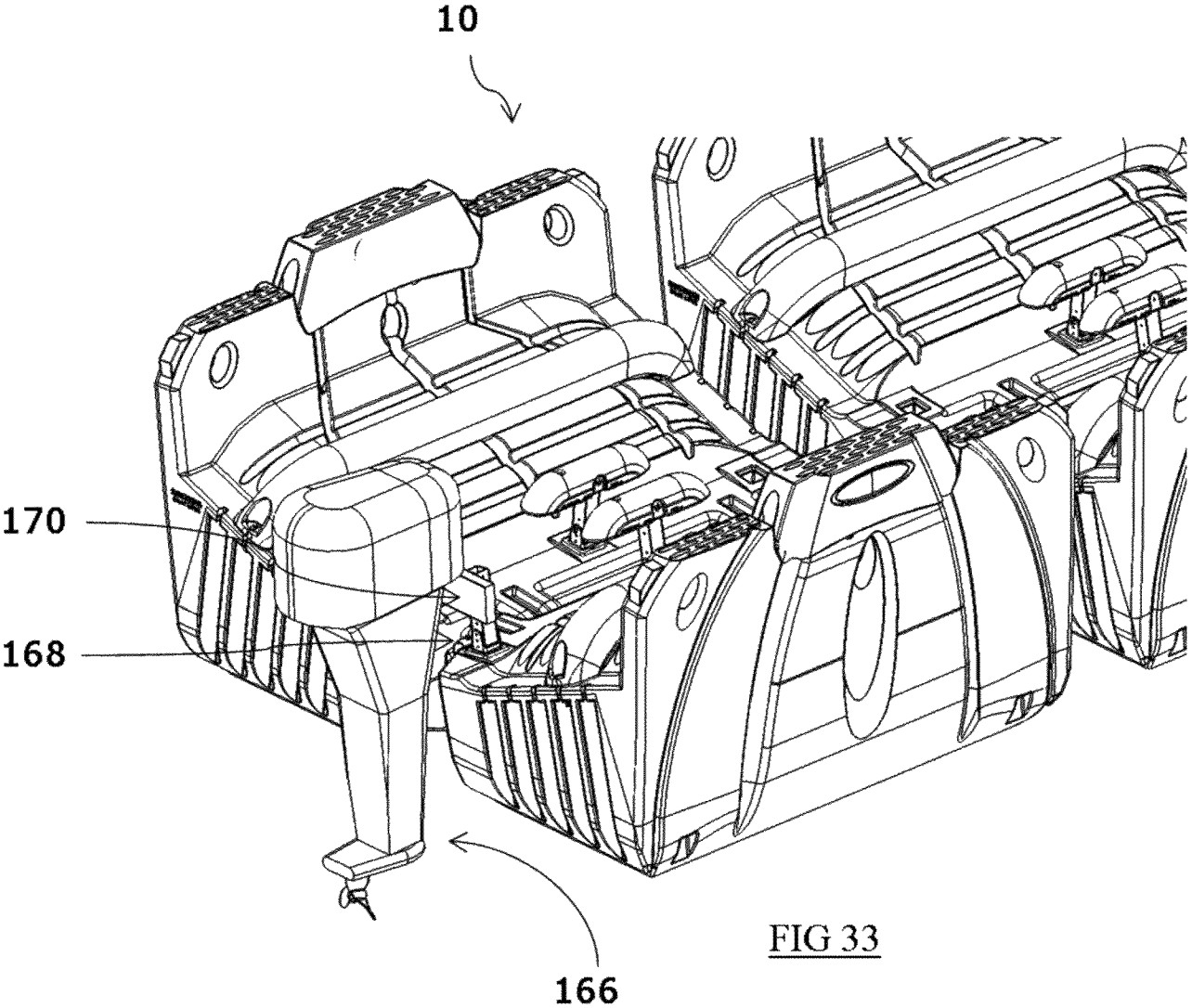
Figure 34:
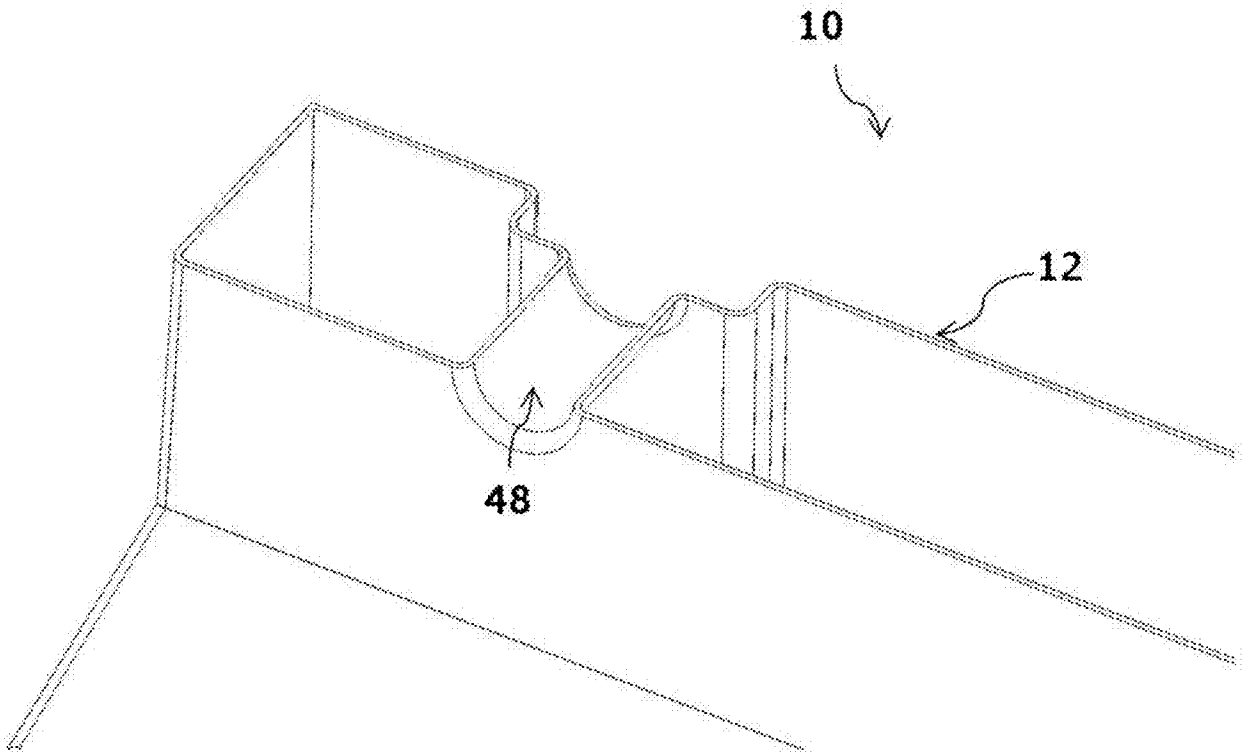
Figure 35:
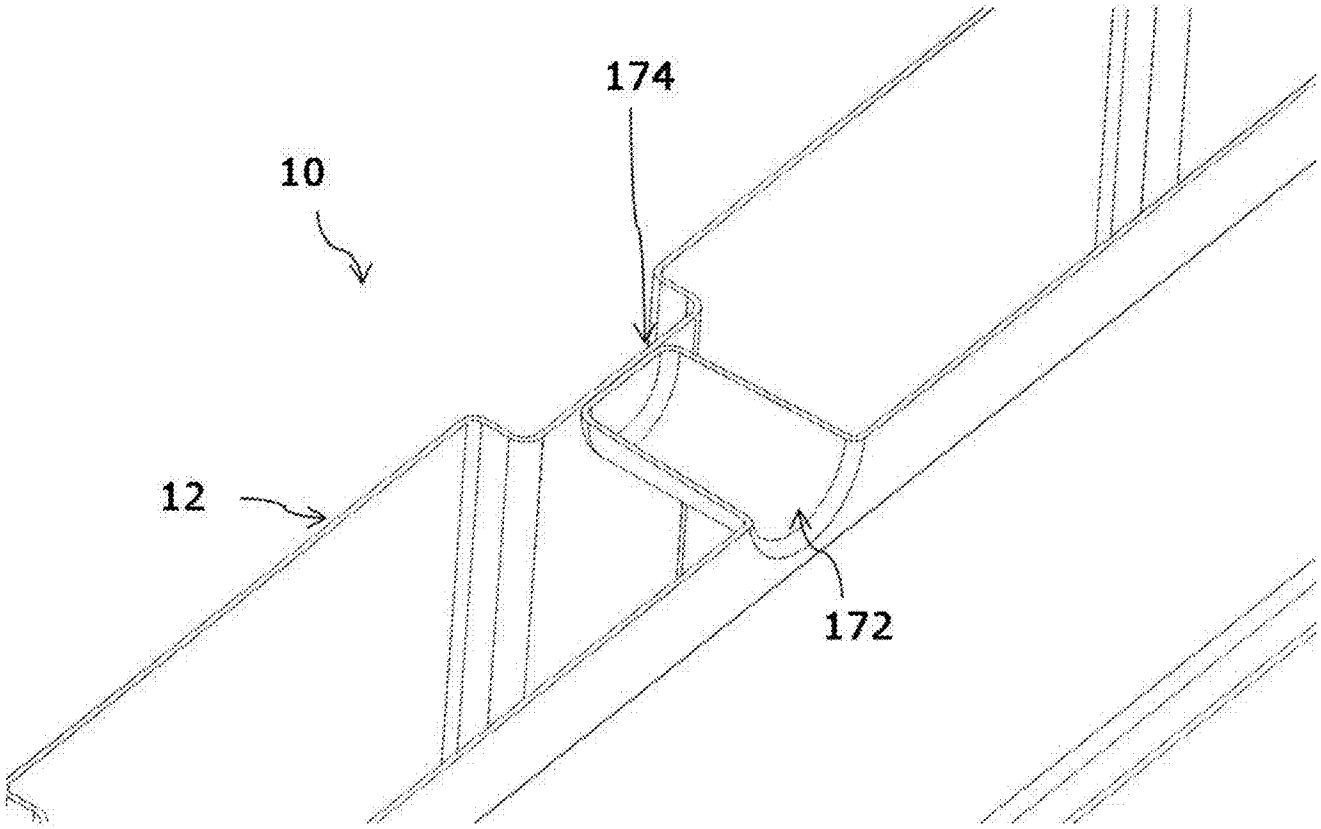
Figure 36:
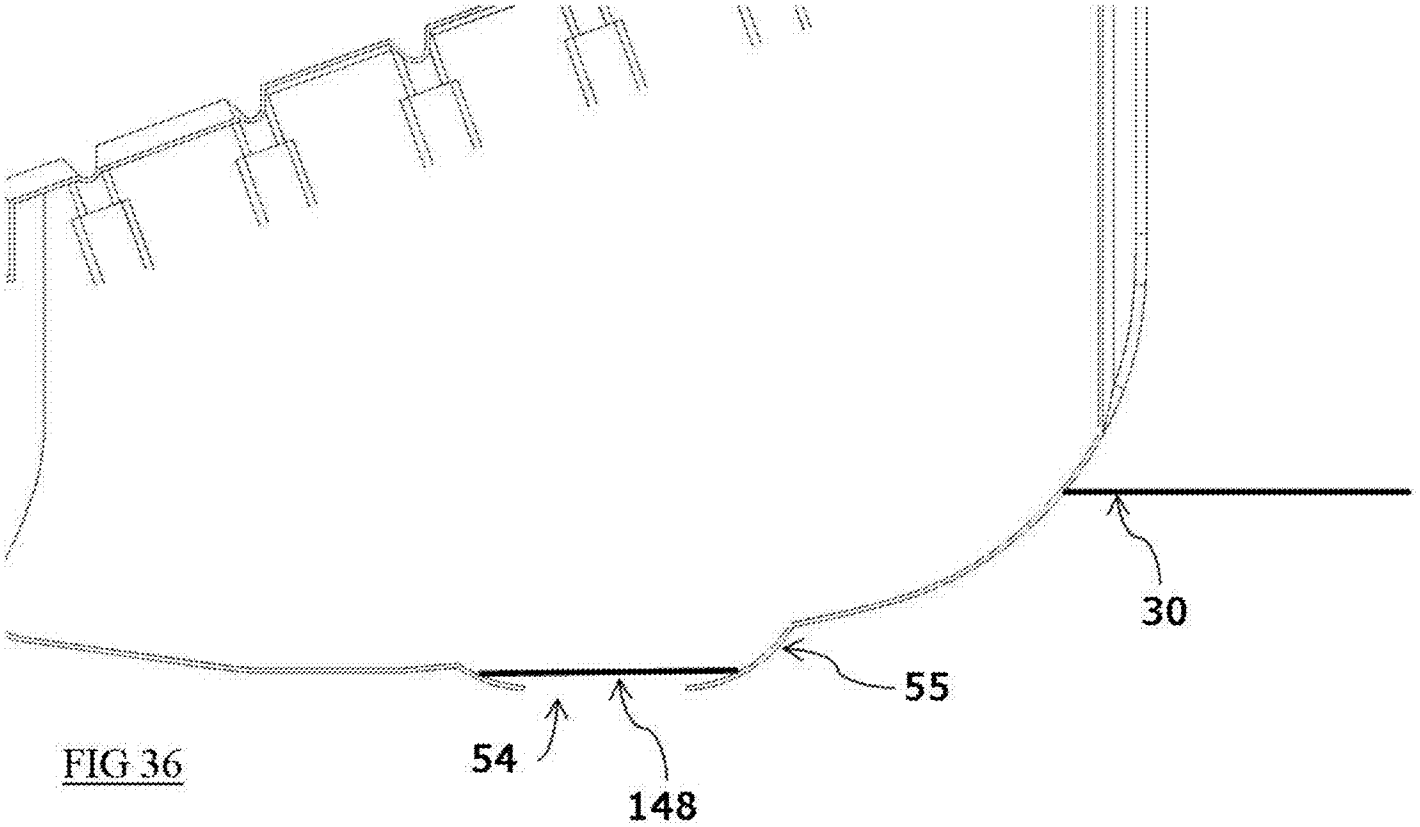
Figure 37:
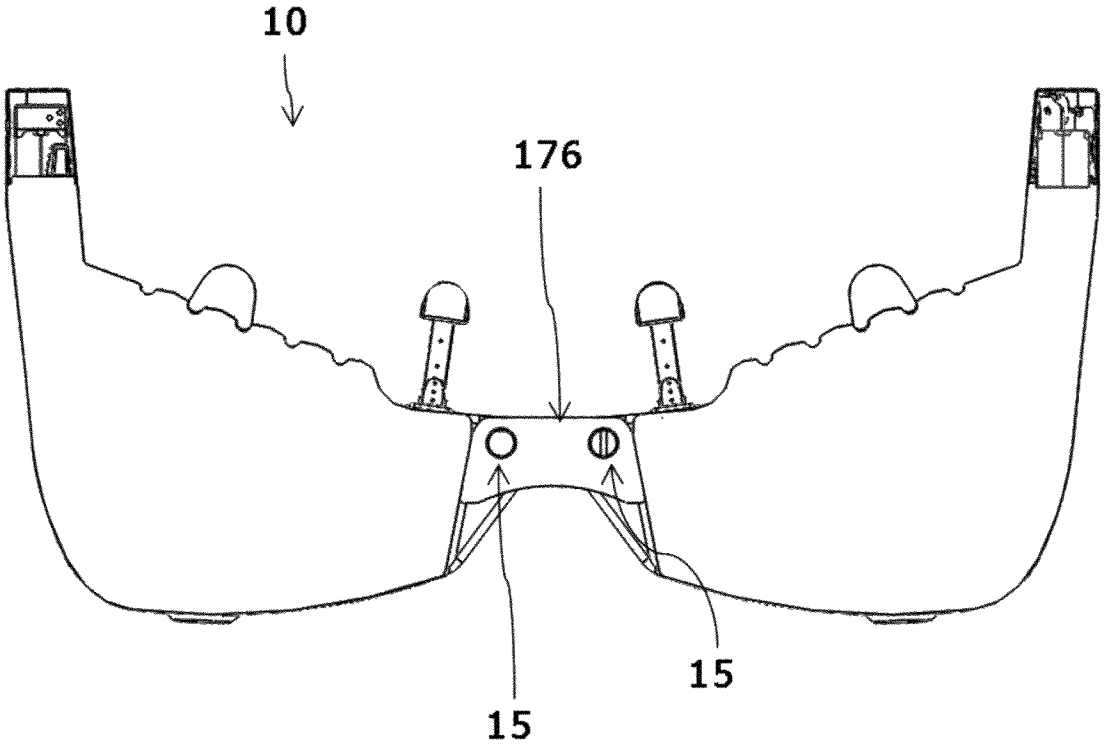

FIG. 1—Side view with boat on lift
FIG. 2—Rear view in Up position
FIG. 3—Rear view in Down position
FIG. 4—Iso view without boat with lids removed for clarity
FIG. 5—Iso close-up view of systems under lid
FIG. 6 Top view of systems under lid
FIG. 7 Exploded view of Blower, down valve
FIG. 8 Cut away view of valve in tank
FIG. 9 Detail of drain hole in Blower
FIG. 10 Detail of Bottom exit hole FIG. 11 Hand hold detail
FIG. 12 Lid Lock detail
FIG. 13 Lid stud detail
FIG. 14 Battery
FIG. 15 Wire harnesses
FIG. 16 Center bunk cross section
FIG. 17 Top view
FIG. 18 Twin hull pontoon boat
FIG. 19 Tri-hull pontoon boat
FIG. 20 Expanded capacity config
FIG. 21 Shallow water rollers
FIG. 22 Canopy
FIG. 23 Rail
FIG. 24 Trailer
FIG. 25 Slide mount
FIG. 26 Slide mount cross section
FIG. 27 Knuckle detail
FIG. 28 Wedge detail
FIG. 29 Tank Monitoring System probe
FIG. 30 Chine guide
FIG. 31 Reducing lift width
FIG. 32 Removable clip
FIG. 33 Outboard mount
FIG. 34 Chine guide through hole
FIG. 35 Chine guide kiss off
FIG. 36 Lower exit hole
FIG. 37 Lift widener

DETAILED DESCRIPTION OF THE INVENTION

The disclosed embodiments of the present invention are floating air displacement boat lift systems for a watercraft that allows for safe, fast, and easy lifting and launching. The combination of features make this boat lift more practical for wide-spread use due to the desirable combination of low cost, durability, simplicity of assembly/installation and versatility of installation locations. The remote control makes it easier and safer to operate, and the multiple blowers and valves make it faster. The lack of hoses and a leak detection and automatic filling system makes the system more reliable. The lack of frame reduces cost, weight, assembly time and corrosion. The narrow width and the shallow water operation increases locations where this design can be used.

The lift 10 is comprised of 2 or more pairs of polyethylene air tanks 12, arranged longitudinally. Each pair is connected pivotally on the centerline with an axle 15. The fore and aft pairs of tanks are connected using a union tube 16 inside each axle. Another embodiment replaces the pivoting axle with hard mounting the port and starboard tanks together. Another uses a frame to connect the tanks. Another connects the front and rear tanks by connecting the bunks or by connecting the tanks with structure. The pivot connection is the preferred embodiment since it does not use a frame, and the stresses in the plastic are less. It is more durable, less costly, and lighter weight to transfer the weight of the boat directly to the tank, or through a replaceable bunk 28 to the tank instead of from the boat to bunk to frame to tank. A rubber bellows 18 over the union tube provides support for the wire harnesses. The capacity of the lift can be increased by adding more tank pairs longitudinally using additional union tubes FIG. 20. The lift can be widened using an additional spacer along the centerline FIG. 37.

Pneumatics

Each tank 12 has a down valve 40, up valve 38 each connected directly to the tank with separate locations. The valves are diaphragm valves actuated by electric solenoids. These valves are normally closed and opened using 4-5 amps of 24V. After one second, the power is reduced to approximately 1 amp using Pulse width Modulation, or by switching the electrical circuit of the 4 valves from parallel to serial. The reduced amps keep the solenoids from overheating, and saves power. The blower 36 is connected to the up valve 40. An elbow pipe is permanently attached to the blower 36. The other end of the elbow slip-fits into the Up valve 38 and secured with friction and gravity for ease of installation and removal FIG. 7. The blower 36 is intentionally mounted on a slight angle so the intake of the blower cannot be choked off to the lid if blower rotates. The orientation of the valves 38,40, blower 36 and battery 32 minimizes width so lift width is minimized. A check valve may also be used instead of a diaphragm valve for the up valve, however check valves are not ideal for sealing low pressure like this application (less than 1 psi). A controller 34 on one of the tanks controls all the systems at same time. A pair of batteries 32 power the system and are located on the aft floats to add some entry slope for the boat when loading. The batteries 32 are charged with solar panel(s) 51 or an AC charger 33. The solar panels 51 are mounted on the top of some of the lids 14. The controller is operated with a wireless transmitter 37 or a manual switch 39. To lift, the blowers 36 are activated, and the up valve 38 is opened. Air is forced into the tank 12 from above, and pushes water out the bottom through an exit hole 54 at the bottom of the tank. The exit hole 54 needs to be large enough to minimize restriction of the exiting and entering water, also considering that marine growth will reduce the opening over time. The diameter of the exit hole 54 for the preferred embodiment is between 3 and 8 inches. The exit hole 54 is located so the air bubbles are directed to the outside of the lift, so the user can see the lift is fully raised. Additional exit holes higher up on the tank to limit the lifting range vertically. To lower the lift, the down valves 40 are opened, releasing air out the top of the tank and allowing water to enter through the lower exit hole 54. For additional lowering speed, the up valves 38 can be opened as well. A small hole 52 in the bottom of the blower fan cage allows any water to drain out of the blower 36. An air-resistant plug can be added to the drain hole to reduce air leakage. Wire harnesses 80, 82, 84 connect the batteries to the controller 34 and the controller to the blowers 36 and valves 38, 40. The lower exit hole 54 has a shallow lip 55 around the perimeter of the hole extending downward, which helps to maintain air in the tank when lift is angled.

RC Features

For additional security, the manual switch 39 on the controller 34 can be disabled using a key 35 on the controller 34. To notify the user of low battery 32, the controller 34 stops wireless operation so lift can only be operated with the manual switch 39 on the controller 34. An audible sound when operating also gives indication of low battery 32. A second identical controller 37 is used for the 6 or 8 tank configuration FIG. 20. A wire connecting the first and second controller switches one controller to be a slave, controlled by the first controller 34.

Tank Design

The air tanks 12 are designed with a top section that remains above water called the chine guide 49. The inner surface of the chine guide helps to position the boat laterally on the lift. A trapped air pocket keeps buoyancy in the top section of the chine guide 49. The specific dimensions of the chine guide 49 above waterline in the lowered position is critical. Using the dimensions in this preferred embodiment, a 8.5 ft boat 20 (the typical max width) can fit in a 10 ft wide slip 138 (a common slip size for marinas). It also gives appropriate volume to support a person while boarding, and gives clearance for roof column supports 160. The air pocket is created using the 6 inch long vertical tunnels in the air tanks used for the valve mounting FIG. 8. The trapped air pocket is preferred over foam buoyancy for cost and weight. The preferred dimensions for the width of the chine guide is between 5-11" measured from the inside of the chine guide at the elevation of the boat's chine horizontally to the outermost width of the outside of the chine guide FIG. 30. The inside edge of the chine guide is best to be angled to best match the angle of the sides of the boat 20. The preferred volume of the chine guide 49 above water in the down position is between 3 and 6 cubic feet.

The chine guide 49 has three through-holes 48, 50 laterally. These assist to maintain the shape of the air tank when pressured, and gives locations to secure the lift 10 using dock lines 43 or other mounting 126. A vertical hand-rail 124 can be mounted from one of these holes, and hooked at the bottom in the side hand hold. This hand-rail can also be used to keep the lift from sliding under the dock. A similar vertical upright tube can be used to mount a canopy 120 over the lift. Another embodiment uses kiss-offs instead of the through hole 172. A kiss off has a blind hole 172 that connects structurally to the surface on the other side of the tank 174.

The deck of the lift 21 is angled so that the incoming air is contained to the outboard side of the tanks for lateral stability. Additional prop clearance 23 in the tank is created near the centerline. The bottom of the tank is made as wide as possible to minimize water depth required. The hinges are positioned so the port and starboard tanks are the same part design. The section of the tank at the waterline is sloped 5 degrees or more to hide marine growth. The sides of the tank 12 are substantially vertical, but have a slight slope that creates more gap between the lift 10 and dock 138 when raised. This gives the lift maximum clearance to a tight slip when raised and stored, but providing adequate stability when raised by maximizing footprint. Knuckles 140 on the tanks prevent the tank pairs from rotating too far outward. A separate wedge 142 can also be used to limit the outward rotation. A removable clip 141 on top of the axle prevents the tank 12 pairs from rotating too far inward. This clip 41 can be removed when user needs to install into a tight slip with roof supports mounted on the inside of the slip FIG. 31, or when making the lift more narrow for trailering is desirable (such as being within the 8'6" highway width limits).

An air pocket 144 on the bottom of the tank toward the center line provides additional buoyancy when lowered, and helps keeps the lift from folding in the lowered position without a boat when the removable clip 141 on the axle 15 is removed.

The lid 14 is partially recessed into the tank 12 for protection, appearance, minimizing overall height and providing more reserve buoyancy when lowered The tank 12 also has hand-holds 56, 58 on the fore and aft ends and on the sides to assist in handling the tanks 12

Bunks

The boat 20 is supported with replaceable air-filled polyethylene bunks 28,22. The outer bunks 28 are connected directly to the air tanks 12. The boat 20 and outer bunks 28 provide the upper structure for the air tanks 12, maintaining shape while pressured. The outer bunks 28 alone provide significant structure for the top of the air tank when raised without a boat 20. The shape of the outer bunks 28 are arched to be more effective in bending strength. The outer bunks 28 can be installed in various lateral positions to best fit the watercraft 20. The bunks index 59 on to grooves on deck of tank to provide lateral strength. The grooves 59 in the tank give the deck more strength. A wide variety of boat 20 types fit on the lift just by adjusting the inner bunks 22 vertically, and the outer bunks 28 laterally without the need for special kits. The current embodiment accepts V-hull boats, ski boats, and pontoon boats. The center bunk legs 24 are oriented with a slight inward slope so the center bunks 22 become closer when raised to better fit a tri-hulled pontoon boat, and the lateral load from a v-hull boat 20 is reduced. The center bunks 22 are sized to be as short as possible to add clearance for inboard boats, but long enough to minimize load pressure on hull of boat. The center bunks 22 are telescoping vertically to best fit boats, and to adjust the width of the lift. The adjustment of the center bunk 22 changes the angle of the tank 12 pair, which adjusts max width of the lift, and width between chine guides 49. The center bunk 22 is installed in a rectangular through hole 92 in the tank to telescope and to keep from rotating. Two additional rectangular holes 92 are available in the front and aft sections of the tank for additional bunks, or to be used for accessories such as a motor stop 88, bow stop or motor mount 170. A motor stop may also be mounted to the aft end of the aft axle. The top section of the center bunks 22 are designed to be pivoting in the plane of the centerline of the lift, but maintain a slope rearward to best accept a boat. The center bunk 22 can also be installed with the rear of the center bunk facing the front to keep the bunks from hooking on steps of a stepped hull boat. The center bunk 22 can also be locked from rotating by adding an additional bolt underneath the pivot. Above water, gravity pulls the aft end down pivoting around a pivot pin since the pivot is ahead of the balance point. Below water, an air pocket in the front pulls the front of the bunk upward. Stops 102, 104 between the bunk and the support leg prevents the bunk from angling forward as well as aft. For shallow water applications, a roller set 118 can be used for the center bunks so the boat can roll up on to a lift that is grounded FIG. 21. A foot 116 on the bottom of the center bunk leg 24 transfers boat 20 weight directly from the boat 20 to the ground 29 so the weight of the boat does not crush the plastic tank 12. The center bunk leg 24 is vertically supported using a locking collar 26 that indexes into the square socket molded in the tank 92. The center bunk 22 is vertically adjusted with multiple holes in the support leg 24 and locking collar 26 which helps to distribute the load into the tank 12. A square leg socket 92 in the tank is tapered, being wider from the top for manufacturability and to index the locking collar 2 in place. The outer bunks 28 are normally filled with air, but can be flooded to reduce positive buoyancy in the down position if desired. In another embodiment, the boat is supported directly on the tanks (FIG. 18).

The lift is designed for easy assembly and maintenance, using only a Philips head screwdriver. The valves 38. 40 are installed into the tank without tools. Each valve 38, 40 is connected to a pipe 42 with a pair of o-rings 44, 46, seated in grooves in the pipe 42. The outer diameter of the upper o-ring 44 is larger than the lower o-ring 46 so it seats securely in a 6" deep tapered round tunnel the tank. Lubrication on the o-rings 44, 46 assists in sealing and removal.

The electrical components of the lift are protected from the water with an air-bell lid 14, which keeps the components dry in an air pocket if submerged. Two threaded studs 62 protrude vertically from the top of the tank 12, which accepts two holes in each lid 16. The studs 62 protrude through the edge of the lid 14 and thumb nuts 64 secure the lid 14 down. The lift 10 can be locked to prevent operation of the lift by locking a padlock 60 through a hole in the stud 62. The stud 62 has an anti-rotation pin 66 to prevent the stud 62 from being removed when locked. The lid 14 is also used as a boarding step to the boat. An intake/exhaust hole 41 is located in the lid 14 as high as possible to minimize risk of water intake when lifting, but located under the critical electrical components. The max angle of the tank needs to be considered when positioning the intake/exhaust hole 41 in the lid.

Dock Lines and Mounts

The lift 10 can be connected to the dock 138 using dock lines 43 from the lateral holes in the tanks 48. Another method of connecting the lift to connect the lift to a vertical pipe 128 mounted to the dock 138 using an elastomeric connection 126.

The geometry of the lift 10 combined with the appropriate amount of trapped air creates positive buoyancy in the lowered position, and secures the boat lightly when the lift is in the down position. The multiple blowers 36 acting together lifts the watercraft 20 substantially horizontally. The combination of these two features eliminate the need to tie the boat 20 to the lift 10 when lifting.

Control

The lift 10 can be actuated up or down with a manual switch 39 on the control box 34, or with a transmitter 37. The manual switch 39 can be deactivated with a key 35 on the controller for security. To alert the user of a low battery 32 condition, the controller 34 automatically disables the remote control feature if battery capacity is below 25% (with low voltage being the indication). Studs for connecting 24V lights are located on the control box 34 and activated with the transmitter 37.

Tank Monitoring System

The lift 10 has a Tank Monitoring System, which automatically adds air to the tanks if it senses at least one of the tanks are taking on water. A two strand wire 150 is suspended in each tank, with the lower ends of the wires 152, 154 exposed about 10 inches over the bottom of the tank 12. The ends of the wires 152, 154 are separated to so they cannot touch each other. The wire is inside a stiff, formed pipe 156 which keeps the ends of the wires from touching the edge of the tank 12. The controller 34 measures the resistance in these wires. If the wires are submerged, the controller 34 senses the decreased resistance and turns all blowers 36 on for a length of time. If the Tank Monitoring System is activated, the system can notify the user with an audible sound next time it is operated. The system checks the resistance in the wires every 12 hours, and activates the blowers 36 for 1 minute when activated, which equates to a volume of air of one half the volume of the tank in the preferred embodiment. This frequency limits power use and overuse of blowers 36, but still gives protection of up to leak rates of one tank volume per day.

Power Grid, Batteries

A power grid of 24V is available under each lid 14 using a plug for each tank. Each of these plugs can accept a battery 32, AC charger 33, or solar charger 51. Each battery 32 has a male 76 and female plug 76 so a battery and charger can be used at the same power grid plug location. The male/female plugs on the battery also enable multiple batteries 32 to be charged at once off the lift. Each 24V battery 32 is comprised of a pair of 12V sealed lead acid batteries 72, connected with a fusible link 74. A handle 80 assists in handling. The batteries are best mounted on the aft pair of tanks to create an entry slope for the boat. The tank has a recess to accept the battery to secure with gravity.

Trailer, Feet

To maximize portability, a trailer 124 can be used to take the lift out of the water, with or without a boat. The primary load of the boat 20 is transferred from the center bunk legs 24 to the trailer structure 124 so the tanks 12 are not crushed.

Shallow Water

This invention is well-suited for shallow water operation. The wide width of the tanks 12 minimizes the draft of the lift 10 when loaded. Since it is free-floating with no leveling brackets, the front of the lift 10 can ground out, but allow the rear part of the lift 10 can be lower. In addition, the embodiment with rollers assembly 118 on the center bunks allow the boat to roll on to the lift. The embodiment with the feet on the center bunk leg 116 protects the plastic air tanks from being crushed by transferring load from the boat 20 to the ground 29.

Capacity Expansion

The capacity can be expanded by adding additional pairs of tanks 12, connected with additional axle unions 16. The preferred embodiment uses a separate slave controller 37, wired to the primary controller 34.

OBJECTS AND ADVANTAGES

Accordingly, several objects and advantages of this invention are:

1. Portable, free-floating boat lift that fits in 10 ft slip with 8.5 ft wide boat
2. High-speed lifting and lowering with remote control ease of operation
3. High reliability
4. No frame, no metal structure
5. No hoses
6. No powerpack on dock
7. Shallow water operation
8. Solar or AC charged battery system
9. Expandable capacity
10. Load from air tanks is transferred directly to bunks
11. Canopy, hand-hold, trailer, motor stop, and bow stop options
12. Air bell protecting electrical.
13. Fast and easy assembly
14. Width can be easily adjusted. Can be less than 8.5 ft wide with trailering
15. Similar cost, but improved features over previous designs
16. Can be moved independently with an outboard The following describes various aspects disclosed in the present application:

1. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon and a lower side portion;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the aft port and starboard air tanks each having an upper side portion for receiving and supporting the watercraft thereon and a lower side portion, the aft set of air tanks being retained in a position aft of the forward set of air tanks, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position; and each of the port and starboard air tanks of the forward and aft sets of air tanks having a second aperture and a blower connected to the second aperture to selectively provide pressurized air to the internal chamber of the air tank.

2. The watercraft lift of aspect 1 wherein each of the port and starboard air tanks of the forward and aft sets of air tanks further includes a third aperture to selectively release pressurized air from the internal chamber of the air tank.

3. The watercraft lift of aspect 2 wherein each of the port and starboard air tanks of the forward and aft sets of air tanks has a first valve connected between the second aperture and the blower to control the flow of pressurized air to the internal chamber of the air tank, and a second valve connected to the third aperture to control the flow of pressurized air released from the internal chamber of the air tank.

4. The watercraft lift of aspect 1 wherein each of the port and starboard air tanks of the forward and aft sets of air tanks has sufficient rigidity to not collapse when pressurized air therein is reduced.

5. A watercraft lift for raising and lowering a watercraft in water for watercraft having a width of up to 8.5 feet, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon and a lower side portion, the forward port and starboard air tanks each having an upwardly projecting portion located adjacent to the laterally outward side thereof and projecting upward above the upper side portion, the upwardly projecting portion being defined by a laterally outward side portion and a laterally inward side portion separated by from 5 to 10 inches, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the aft port and starboard air tanks each having an upper side portion for receiving and supporting the watercraft thereon and a lower side portion, the aft port and starboard air tanks each having an upwardly projecting portion located adjacent to the laterally outward side thereof and projecting upward above the upper side portion, the upwardly projecting portion being defined by a laterally outward side portion and a laterally inward side portion separated by from 5 to 10 inches, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, the aft set of air tanks being retained in a position aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position; and each of the port and starboard air tanks of the forward and aft sets of air tanks having a second aperture for selectively providing pressurized air to the internal chamber of the air tank.

6. The watercraft lift of aspect 5 wherein each of the port and starboard air tanks of the forward and aft sets of air tanks has a blower mounted thereon and connected to the second aperture to selectively provide the pressurized air to the internal chamber of the air tank.

7. The watercraft lift of aspect 6 wherein each of the port and starboard air tanks of the forward and aft sets of air tanks further includes a third aperture to selectively release pressurized air from the internal chamber of the air tank.

8. The watercraft lift of aspect 7 wherein each of the port and starboard air tanks of the forward and aft sets of air tanks has a first valve connected between the second aperture and the blower to control the flow of pressurized air to the internal chamber of the air tank, and a second valve connected to the third aperture to control the flow of pressurized air released from the internal chamber of the air tank.

9. The watercraft lift of aspect 8 wherein the first valve, the second valve and the blower of each of the port and starboard air tanks of the forward and aft sets of air tanks are mounted on the upwardly projecting portion of the air tank and has an air bell lid covering the first valve, the second valve and the blower.

10. The watercraft lift of aspect 9 wherein the first valve, the second valve and the blower of each of the port and starboard air tanks of the forward and aft sets of air tanks are mounted atop the upwardly projecting portion of the air tank.

11. The watercraft lift of aspect 10 wherein the laterally outward side portion of the upwardly projecting portion of each of the port and starboard air tanks of the forward and aft sets of air tanks has a forward portion, an aft portion and a mid-portion therebetween, the mid-portion which projecting laterally outward beyond the forward and aft portions and the first valve, and the upwardly projecting portion has a top portion extending between the laterally inward side portion and the mid-portion of the laterally outward side portion, the second valve and the blower of each of the port and starboard air tanks of the forward and aft sets of air tanks are mounted atop the top portion of the upwardly projecting portion of the air tank.

12. The watercraft lift of aspect 5 wherein the greatest distance between the laterally outward sides of the forward port and starboard air tanks and between the laterally outward sides of the aft port and starboard air tanks is 9 feet 10 inches.

13. The watercraft lift of aspect 5 wherein the laterally outward sides of each of the port and starboard air tanks of the forward and aft sets of air tanks slope downwardly and laterally inward to provide a decreasing distance between lower portions of the laterally outward sides of the forward port and starboard air tanks toward the water when the air tanks are in the raised position.

14. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other and pivotally connected together, the forward port and starboard air tanks each having an upper side portion for receiving and supporting the watercraft thereon, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other and pivotally connected together, the forward port and starboard air tanks each having an upper side portion for receiving and supporting the watercraft thereon, the aft set of air tanks being positioned aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position;

each of the port and starboard air tanks of the forward and aft sets of air tanks having a second aperture for selectively providing pressurized air to the internal chamber of the air tank; and at least one retainer member retaining the aft set of air tanks in position aft of the forward set of air tanks.

15. The watercraft lift of aspect 14 wherein the at least one retainer member includes at least one port bunk attached to and extending between the upper side portions of the forward port air tank and the aft port air tank for supporting one of the port and starboard hull portion of the watercraft thereon, and at least one starboard bunk attached to and extending between the upper side portions of the forward starboard air tank and the aft starboard air tank for supporting the other of the port and starboard hull portion of the watercraft thereon.

16. The watercraft lift of aspect 14 wherein the at least one retainer member includes an axle having a forward axle portion, an aft axle portion and a mid-axle portion extending therebetween, the axle extending between the forward set of air tanks and the aft set of air tanks with the forward axle portion located between the laterally inward sides of the forward port and starboard air tanks and the aft axle portion located between the laterally inward sides of the aft port and starboard air tanks, the laterally inward sides of the forward port and starboard air tanks being pivotally attached together by the forward axle portion of the axle and the laterally inward sides of the aft port and starboard air tanks being pivotally attached together by the aft axle portion of the axle, and the mid-axle portion retaining the aft set of air tanks in position aft of the forward set of air tanks.

17. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other and pivotally connected together, the forward port and starboard air tanks each having an upper side portion for receiving and supporting the watercraft thereon, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other and pivotally connected together, the forward port and starboard air tanks each having an upper side portion for receiving and supporting the watercraft thereon, the aft set of air tanks being positioned aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft; and an axle extending between the forward set of air tanks and the aft set of air tanks with a forward portion located between the laterally inward sides of the forward port and starboard air tanks and an aft portion located between the laterally inward sides of the aft port and starboard air tanks, the laterally inward sides of the forward port and starboard air tanks pivotally attached together by the forward portion of the axle and the laterally inward sides of the aft port and starboard air tanks pivotally attached together by the aft portion of the axle.

18. The watercraft lift of aspect 17 wherein each of the forward port and starboard air tanks has a laterally inward projecting member pivotally attached to the forward portion of the axle and each of the aft port and starboard air tanks has a laterally inward projecting member pivotally attached to the aft portion of the axle.

19. The watercraft lift of aspect 18 wherein the axle retains the aft set of air tanks in position aft of the forward set of air tanks.

20. The watercraft lift of aspect 17 wherein the axle extends along a centerline of the watercraft lift.

21. The watercraft lift of aspect 17 wherein the axle is flexible to permit off-axis bending of the axle to permit other than pivotal movement of the forward set of air tanks relative to the aft set of air tanks.

22. The watercraft lift of aspect 17 further including at least one port bunk attached to the upper side portion of each of the port and starboard air tanks of the forward and aft sets of air tanks for supporting the watercraft thereon.

23. The watercraft lift of aspect 17 further including for each of the port and starboard air tanks of the forward and aft sets of air tanks: a blower, at least a first valve connected to the blower to provide pressurized air to the internal chamber of the air tank, and at least a second valve by which pressurized air is released from the internal chamber of the air tank.

24. The watercraft lift of aspect 23 further including a controller mounted to one of the port and starboard air tanks of the forward and aft sets of air tanks which is operable to simultaneously control the operation of the blowers for all of the air tanks.

25. The watercraft lift of aspect 24 further including a remote control for remotely controlling the operation of the controller.

26. The watercraft lift of aspect 23 wherein each of the port and starboard air tanks of the forward and aft sets of air tanks has a lower side portion with an aperture positioned below the water for the passage of water into the internal chamber of the air tank when pressurized air is released from the internal chamber and the air tank sinks toward the lowered position and for the passage of water out of the air tank when pressurized air is provided to the internal chamber and the air tank rises toward the raised position.

27. The watercraft lift of aspect 26 further including a downwardly projecting lip extending about each of the apertures to limit the pressurized air released from the internal chamber of the air tank as the lateral angle of the air tank changes as a result of wave action of the water.

28. The watercraft lift of aspect 17 wherein each of the port and starboard air tanks of the forward and aft sets of air tanks has an upwardly projecting portion projecting above the upper side portion and defining a limited first portion of the internal volume of the internal chamber of the air tank, the upwardly projecting portion being positioned to remain above the water as the air tank moves between the raised position and the lowered position and sized to trap sufficient air therein to provide sufficient buoyancy to prevent submersion of an upper portion of the upwardly projecting portion when all other pressurized air is released from the internal chamber.

29. The watercraft lift of aspect 17 wherein each of the port and starboard air tanks of the forward and aft sets of air tanks has an upwardly projecting portion projecting above the upper side portion and defining a limited first portion of the internal volume of the internal chamber of the air tank, the upwardly projecting portion being positioned to remain above the water as the air tank moves between the raised position and the lowered position and sized to trap sufficient air therein to provide sufficient buoyancy to prevent submersion of an upper portion of the upwardly projecting portion when all other pressurized air is released from the internal chamber.

30. The watercraft lift of aspect 17 further including for each of the port and starboard air tanks of the forward and aft sets of air tanks: a blower, at least a first valve connected to the blower to provide pressurized air to the internal chamber of the air tank, and at least a second valve by which pressurized air is released from the internal chamber of the air tank, and wherein each of the port and starboard air tanks of the forward and aft sets of air tanks has an upwardly projecting portion projecting above the upper side portion and defining a limited first portion of the internal volume of the internal chamber of the air tank, the upwardly projecting portion being positioned to remain above the water as the air tank moves between the raised position and the lowered position, each of the upwardly projecting portions having an upper end at which the blower, first valve and second valve for the air tank are positioned.

31. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon and a lower side portion, the forward port and starboard air tanks each having an upwardly projecting portion located adjacent to the laterally outward side thereof and projecting upward above the upper side portion, the upwardly projecting portion being defined by a laterally outward side portion and a laterally inward side portion, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the aft port and starboard air tanks each having an upper side portion for receiving and supporting the watercraft thereon and a lower side portion, the aft port and starboard air tanks each having an upwardly projecting portion located adjacent to the laterally outward side thereof and projecting upward above the upper side portion, the upwardly projecting portion being defined by a laterally outward side portion and a laterally inward side portion, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, the aft set of air tanks being retained in a position aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the upwardly projecting portions of each of the port and starboard air tanks of the forward and aft sets of air tanks has a reinforcing member attached to one of the laterally outward side portion and the laterally inward side portion of the upwardly projecting portion and extending toward the other of the laterally outward side portion and the laterally inward side portion;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position; and each of the port and starboard air tanks of the forward and aft sets of air tanks having a second aperture for selectively providing pressurized air to the internal chamber of the air tank.

32. The watercraft lift of aspect 31 wherein each of the upwardly projecting portions of each of the port and starboard air tanks of the forward and aft sets of air tanks has a first aperture in the laterally outward side portion and a second aperture in the laterally inward side portion of the upwardly projecting portion, and the reinforcing member has first and second open ends with an interior passageway extending between the first and second open ends, the first open end being attached to the laterally outward side portion in sealing engagement therewith at the first aperture with the passageway in communicate with the first aperture and the second open end being attached to the laterally inward side portion in sealing engagement therewith at the second aperture with the passageway in communicate with the second aperture to prevent leakage of pressurized air from within the upwardly projecting portion through the passageway while the passageway of the reinforcing member provides a pass-through between the laterally outward side portion and inward side portion of the upwardly projecting portion.

33. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon and a lower side portion, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the aft port and starboard air tanks each having an upper side portion for receiving and supporting the watercraft thereon and a lower side portion, the aft set of air tanks being retained in a position aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position, the first aperture having a downwardly projecting lip extending thereabout to limit the pressurized air released from the internal chamber of the air tank as the lateral angle of the air tank changes as a result of wave action of the water; and each of the port and starboard air tanks of the forward and aft sets of air tanks having a second aperture for selectively providing pressurized air to the internal chamber of the air tank.

34. A selectively controllable buoyancy device for use in a watercraft lift for raising and lowering a watercraft in water, comprising:

an air tank having an internal chamber configured to receive and release pressurized air, the air tank having an upper side portion for receiving and supporting the watercraft thereon and a lower side portion, the air tank having sufficient rigidity to not collapse when pressurized air therein is reduced, the internal chamber having sufficient internal volume that when sufficient pressurized air is received therein the air tank has sufficient buoyancy to assist in raising the watercraft to a raised position with the watercraft out of the water when the watercraft is positioned on the upper side portion of the air tank, and that when sufficient pressurized air is released from the internal chamber of the air tank the air tank loses sufficient buoyancy to sink to a lowered position sufficiently submerged to receive and deploy the watercraft;

a first aperture in the lower side portion of the air tank positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position, the first aperture having a downwardly projecting lip extending thereabout to limit the pressurized air released from the internal chamber of the air tank as the lateral angle of the air tank changes as a result of wave action of the water; and a second aperture in the air tank for selectively providing pressurized air to the internal chamber of the air tank.

35. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon and a lower side portion, the forward port and starboard air tanks each having an upwardly projecting portion located adjacent to the laterally outward side thereof and projecting upward above the upper side portion, the upwardly projecting portion being defined by a laterally outward side portion and a laterally inward side portion, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the aft port and starboard air tanks each having an upper side portion for receiving and supporting the watercraft thereon and a lower side portion, the aft port and starboard air tanks each having an upwardly projecting portion located adjacent to the laterally outward side thereof and projecting upward above the upper side portion, the upwardly projecting portion being defined by a laterally outward side portion and a laterally inward side portion, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, the aft set of air tanks being retained in a position aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position; and each of the port and starboard air tanks of the forward and aft sets of air tanks having a second aperture and a blower connected to the second aperture and mounted on the air tank to selectively provide pressurized air to the internal chamber of the air tank.

36. The watercraft lift of aspect 35 wherein each of the port and starboard air tanks of the forward and aft sets of air tanks further includes a third aperture to selectively release pressurized air from the internal chamber of the air tank.

37. The watercraft lift of aspect 36 wherein each of the port and starboard air tanks of the forward and aft sets of air tanks has a first valve connected between the second aperture and the blower to control the flow of pressurized air to the internal chamber of the air tank, and a second valve connected to the third aperture to control the flow of pressurized air released from the internal chamber of the air tank.

38. The watercraft lift of aspect 37 wherein the first valve, the second valve and the blower of each of the port and starboard air tanks of the forward and aft sets of air tanks are mounted on the upwardly projecting portion of the air tank.

39. The watercraft lift of aspect 38 wherein the first valve, the second valve and the blower of each of the port and starboard air tanks of the forward and aft sets of air tanks are mounted atop the upwardly projecting portion of the air tank.

40. The watercraft lift of aspect 38 wherein the upwardly projecting portion has a top portion extending between the laterally inward side portion and the mid-portion of the laterally outward side portion, the first valve, the second valve and the blower of each of the port and starboard air tanks of the forward and aft sets of air tanks are mounted atop the top portion of the upwardly projecting portion of the air tank.

41. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the forward port and starboard air tanks each having an upper side portion for receiving and supporting the watercraft thereon, the aft set of air tanks being retained in a position aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position; and each of the port and starboard air tanks of the forward and aft sets of air tanks having a second aperture and a blower connected to the second aperture and mounted on the air tank to selectively provide pressurized air to the internal chamber of the air tank.

42. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon and a lower side portion, the forward port and starboard air tanks each having an upwardly projecting portion located adjacent to the laterally outward side thereof and projecting upward above the upper side portion, the upwardly projecting portion being defined by a laterally outward side portion and a laterally inward side portion, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the aft port and starboard air tanks each having an upper side portion for receiving and supporting the watercraft thereon and a lower side portion, the aft port and starboard air tanks each having an upwardly projecting portion located adjacent to the laterally outward side thereof and projecting upward above the upper side portion, the upwardly projecting portion being defined by a laterally outward side portion and a laterally inward side portion, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to provide sufficient buoyancy to prevent submersion of an upper portion of the upwardly projecting portion when all other pressurized air is released from the internal chamber, the aft set of air tanks being retained in a position aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

a bunk support leg having an upper portion and a lower portion;

a bunk for supporting the watercraft thereon, the bunk being attached to the upper portion of the bunk support leg;

each of the port and starboard air tanks of the forward and aft sets of air tanks having a receiving socket formed in the upper side portion, the receiving socket being sized to removably receive therein the lower portion of the bunk support leg;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position; and each of the port and starboard air tanks of the forward and aft sets of air tanks having a second aperture for selectively providing pressurized air to the internal chamber of the air tank.

43. The watercraft lift of aspect 42 wherein the receiving socket being a through hole in the air tank passing fully therethough from the upper side portion to the lower side portion.

44. The watercraft lift of aspect 43 wherein each of the port and starboard air tanks of the forward and aft sets of air tanks has a first aperture in the upper side portion and a second aperture in the lower side portion, and the socket is a channel member having first and second open ends with an interior passageway extending between the first and second open ends, the first open end being attached to the upper side portion in sealing engagement therewith at the first aperture with the passageway in communicate with the first aperture and the second open end being attached to lower side portion in sealing engagement therewith at the second aperture with the passageway in communicate with the second aperture to prevent leakage of pressurized air from within the air tank through the passageway.

45. A watercraft lift for raising and lowering a watercraft in water, comprising:

a plurality of air tanks each having an internal chamber configured to receive and release pressurized air, the air tanks each having an upper side portion for receiving and supporting the watercraft thereon and a lower side portion, the air tanks each having sufficient rigidity to not collapse when pressurized air therein is reduced, the internal chambers of the air tanks in combination having sufficient internal volume that when sufficient pressurized air is received therein the air tanks have sufficient buoyancy to rise to a raised position with the watercraft out of the water when the watercraft is positioned on the upper side portions of the air tanks, and that when sufficient pressurized air is released from the internal chambers of the air tanks the air tanks lose sufficient buoyancy to sink to a lowered position sufficiently submerged to receive and deploy the watercraft;

the air tanks each having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position;

the air tanks each having a second aperture for selectively providing pressurized air to the internal chamber of the air tank;

the air tanks each having a blower to selectively provide the pressurized air to the internal chamber of the air tank and a first electronically activated valve connected between the second aperture and the blower to control the flow of pressurized air to the internal chamber of the air tank; and a controller to electronically activate the operation of the first valve, the controller being configured to initially apply a first electronic signal at an initial power level to the first valve for a set period of time to activate the first valve, and at the expiration of the period of time then apply a second electronic signal at a power level less than the initial power level to the first valve for continued activation of the first valve.

46. The watercraft lift of aspect 45 wherein the first and second electronic signals are pulse width modulated with the first electronic signal having a first activation control pulse width and the second electronic signal having a second activation control pulse width, the second activation control pulse width being shorter than the first activation control pulse width.

47. The watercraft lift of aspect 45 wherein the air tanks each further includes a third aperture to selectively release pressurized air from the internal chamber of the air tank and a second electronically activated valve connected to the third aperture to control the flow of pressurized air released from the internal chamber of the air tank; and the controller electronically activates the operation of the second valve, the controller being configured to initially apply a third electronic signal at an initial power level to the second valve for a set period of time to activate the second valve, and at the expiration of the period of time then apply a fourth electronic signal at a power level less than the initial power level to the second valve for continued activation of the second valve.

48. The watercraft lift of aspect 47 wherein the first and second electronic signals are pulse width modulated with the first electronic signal having a first activation control pulse width and the second electronic signal having a second activation control pulse width, the second activation control pulse width being shorter than the first activation control pulse width, and the third and fourth electronic signals are pulse width modulated with the third electronic signal having a first activation control pulse width and the second electronic signal having a second activation control pulse width, the second activation control pulse width being shorter than the first activation control pulse width.

49. A watercraft lift for raising and lowering a watercraft in water, comprising:

a plurality of air tanks each having an internal chamber configured to receive and release pressurized air, the air tanks each having an upper side portion for receiving and supporting the watercraft thereon and a lower side portion, the air tanks each having sufficient rigidity to not collapse when pressurized air therein is reduced, the internal chambers of the air tanks in combination having sufficient internal volume that when sufficient pressurized air is received therein the air tanks have sufficient buoyancy to rise to a raised position with the watercraft out of the water when the watercraft is positioned on the upper side portions of the air tanks, and that when sufficient pressurized air is released from the internal chambers of the air tanks the air tanks lose sufficient buoyancy to sink to a lowered position sufficiently submerged to receive and deploy the watercraft;

the air tanks each having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position;

the air tanks each having a second aperture for selectively providing pressurized air to the internal chamber of the air tank;

the air tanks each having a blower to selectively provide the pressurized air to the internal chamber of the air tank;

the air tanks each having a sensor positioned in the internal chamber of the air tank for the detection of water in the internal chamber above a preselected level; and a controller to electronically activate the operation of the blower to provide pressurized air to the internal chamber of the one of the air tanks with the sensor positioned therein upon detection of water in the internal chamber above the preselected level.

50. The watercraft lift of aspect 49 wherein the sensor comprises two spaced apart wires suspended inside the internal chamber of the air tank and the controller detects water is in the internal chamber above the preselected level by detecting lowering of the resistance between the wires resulting from their immersion in the water within the internal chamber.

51. The watercraft lift of aspect 50 wherein upon detection of water in the internal chamber above the preselected level the controller electronically activates the operation of the blower for a predetermined time period, and subsequently the controller repeatedly determines after the termination of the prior predetermined time period whether water is still detected in the internal chamber above the preselected level and if water is detected in the internal chamber above the preselected level again electronically activates the operation of the blower for another predetermined time period.

52. A watercraft lift for raising and lowering a watercraft in water and connecting the watercraft lift to a dock having a vertical retainer member attached to the dock, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon and a lower side portion;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the aft port and starboard air tanks each having an upper side portion for receiving and supporting the watercraft thereon and a lower side portion, the aft set of air tanks being retained in a position aft of the forward set of air tanks, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position;

each of the port and starboard air tanks of the forward and aft sets of air tanks having a second aperture to selectively provide pressurized air to the internal chamber of the air tank; and an elastomeric connector having a first end attached to the one of the port and starboard air tanks of the forward set of air tanks oriented toward the dock and a second end slidably received on the vertical retainer member attached to the dock to permit upward and downward movement of the watercraft lift relative to the dock.

The invention claimed is:

1. A watercraft lift for raising and lowering a watercraft in water for watercraft having a width of up to 8.5 feet, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon and a lower side portion, the forward port and starboard air tanks each having an upwardly projecting portion located adjacent to the laterally outward side thereof and projecting upward above the upper side portion, the upwardly projecting portion being defined by a laterally outward side portion and a laterally inward side portion separated by from 5 to 10 inches, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the aft port and starboard air tanks each having an upper side portion for receiving and supporting the watercraft thereon and a lower side portion, the aft port and starboard air tanks each having an upwardly projecting portion located adjacent to the laterally outward side thereof and projecting upward above the upper side portion, the upwardly projecting portion being defined by a laterally outward side portion and a laterally inward side portion separated by from 5 to 10 inches, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, the aft set of air tanks being retained in a position aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position;

each of the port and starboard air tanks of the forward and aft sets of air tanks having a second aperture for selectively providing pressurized air to the internal chamber of the air tank and having a blower mounted thereon and connected to the second aperture to selectively provide the pressurized air to the internal chamber of the air tank;

each of the port and starboard air tanks of the forward and aft sets of air tanks having a third aperture to selectively release pressurized air from the internal chamber of the air tank; and each of the port and starboard air tanks of the forward and aft sets of air tanks having a first valve connected between the second aperture and the blower for the air tank to control the flow of pressurized air to the internal chamber of the air tank, and a second valve connected to the third aperture to control the flow of pressurized air released from the internal chamber of the air tank, with the first valve, the second valve and the blower for each of the port and starboard air tanks of the forward and aft sets of air tanks being mounted on the upwardly projecting portion of the air tank and having an air bell lid covering the first valve, the second valve and the blower for the air tank.

2. The watercraft lift of claim 1 wherein the first valve, the second valve and the blower for each of the port and starboard air tanks of the forward and aft sets of air tanks are mounted atop the upwardly projecting portion of the air tank.

3. The watercraft lift of claim 2 wherein the laterally outward side portion of the upwardly projecting portion of each of the port and starboard air tanks of the forward and aft sets of air tanks has a forward portion, an aft portion and a mid-portion therebetween, the mid-portion which projecting laterally outward beyond the forward and aft portions and the first valve, and the upwardly projecting portion has a top portion extending between the laterally inward side portion and the mid-portion of the laterally outward side portion, the second valve and the blower for each of the port and starboard air tanks of the forward and aft sets of air tanks are mounted atop the top portion of the upwardly projecting portion of the air tank.

4. The watercraft lift of claim 1 wherein the greatest distance between the laterally outward sides of the forward port and starboard air tanks and between the laterally outward sides of the aft port and starboard air tanks is 9 feet 10 inches.

5. The watercraft lift of claim 1 wherein the laterally outward sides of each of the port and starboard air tanks of the forward and aft sets of air tanks slope downwardly and laterally inward to provide a decreasing distance between lower portions of the laterally outward sides of the forward port and starboard air tanks toward the water when the air tanks are in the raised position.

6. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other and pivotally connected together, the forward port and starboard air tanks each having an upper side portion for receiving and supporting the watercraft thereon, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other and pivotally connected together, the forward port and starboard air tanks each having an upper side portion for receiving and supporting the watercraft thereon, the aft set of air tanks being positioned aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position;

each of the port and starboard air tanks of the forward and aft sets of air tanks having a second aperture for selectively providing pressurized air to the internal chamber of the air tank; and at least one retainer member retaining the aft set of air tanks in position aft of the forward set of air tanks, the at least one retainer member having at least one port bunk attached to and extending between the upper side portions of the forward port air tank and the aft port air tank for supporting one of the port and starboard hull portion of the watercraft thereon, and at least one starboard bunk attached to and extending between the upper side portions of the forward starboard air tank and the aft starboard air tank for supporting the other of the port and starboard hull portion of the watercraft thereon, and the at least one retainer member including an axle having a forward axle portion, an aft axle portion and a mid-axle portion extending therebetween, the axle extending between the forward set of air tanks and the aft set of air tanks with the forward axle portion located between the laterally inward sides of the forward port and starboard air tanks and the aft axle portion located between the laterally inward sides of the aft port and starboard air tanks, the laterally inward sides of the forward port and starboard air tanks being pivotally attached together by the forward axle portion of the axle and the laterally inward sides of the aft port and starboard air tanks being pivotally attached together by the aft axle portion of the axle, and the mid-axle portion retaining the aft set of air tanks in position aft of the forward set of air tanks.

7. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other and pivotally connected together, the forward port and starboard air tanks each having an upper side portion for receiving and supporting the watercraft thereon, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other and pivotally connected together, the forward port and starboard air tanks each having an upper side portion for receiving and supporting the watercraft thereon, the aft set of air tanks being positioned aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position;

each of the port and starboard air tanks of the forward and aft sets of air tanks having a second aperture for selectively providing pressurized air to the internal chamber of the air tank; and at least one retainer member retaining the aft set of air tanks in position aft of the forward set of air tanks, the at least one retainer member having an axle having a forward axle portion, an aft axle portion and a mid-axle portion extending therebetween, the axle extending between the forward set of air tanks and the aft set of air tanks with the forward axle portion located between the laterally inward sides of the forward port and starboard air tanks and the aft axle portion located between the laterally inward sides of the aft port and starboard air tanks, the laterally inward sides of the forward port and starboard air tanks being pivotally attached together by the forward axle portion of the axle and the laterally inward sides of the aft port and starboard air tanks being pivotally attached together by the aft axle portion of the axle, and the mid-axle portion retaining the aft set of air tanks in position aft of the forward set of air tanks.

8. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other and pivotally connected together, the forward port and starboard air tanks each having an upper side portion for receiving and supporting the watercraft thereon, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other and pivotally connected together, the forward port and starboard air tanks each having an upper side portion for receiving and supporting the watercraft thereon, the aft set of air tanks being positioned aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft; and an axle extending between the forward set of air tanks and the aft set of air tanks with a forward portion located between the laterally inward sides of the forward port and starboard air tanks and an aft portion located between the laterally inward sides of the aft port and starboard air tanks, the laterally inward sides of the forward port and starboard air tanks pivotally attached together by the forward portion of the axle and the laterally inward sides of the aft port and starboard air tanks pivotally attached together by the aft portion of the axle.

9. The watercraft lift of claim 8 wherein each of the forward port and starboard air tanks has a laterally inward projecting member pivotally attached to the forward portion of the axle and each of the aft port and starboard air tanks has a laterally inward projecting member pivotally attached to the aft portion of the axle.

10. The watercraft lift of claim 9 wherein the axle retains the aft set of air tanks in position aft of the forward set of air tanks.

11. The watercraft lift of claim 8 wherein the axle extends along a centerline of the watercraft lift.

12. The watercraft lift of claim 8 wherein the axle is flexible to permit off-axis bending of the axle to permit other than pivotal movement of the forward set of air tanks relative to the aft set of air tanks.

13. The watercraft lift of claim 8 further including at least one port bunk attached to the upper side portion of each of the port and starboard air tanks of the forward and aft sets of air tanks for supporting the watercraft thereon.

14. The watercraft lift of claim 8 further including for each of the port and starboard air tanks of the forward and aft sets of air tanks: a blower, at least a first valve connected to the blower to provide pressurized air to the internal chamber of the air tank, and at least a second valve by which pressurized air is released from the internal chamber of the air tank.

15. The watercraft lift of claim 14 further including a controller mounted to one of the port and starboard air tanks of the forward and aft sets of air tanks which is operable to simultaneously control the operation of the blowers for all of the air tanks.

16. The watercraft lift of claim 15 further including a remote control for remotely controlling the operation of the controller.

17. The watercraft lift of claim 14 wherein each of the port and starboard air tanks of the forward and aft sets of air tanks has a lower side portion with an aperture positioned below the water for the passage of water into the internal chamber of the air tank when pressurized air is released from the internal chamber and the air tank sinks toward the lowered position and for the passage of water out of the air tank when pressurized air is provided to the internal chamber and the air tank rises toward the raised position.

18. The watercraft lift of claim 17 further including a downwardly projecting lip extending about each of the apertures to limit the pressurized air released from the internal chamber of the air tank as the lateral angle of the air tank changes as a result of wave action of the water.

19. The watercraft lift of claim 18 wherein each of the port and starboard air tanks of the forward and aft sets of air tanks has an upwardly projecting portion projecting above the upper side portion and defining a limited first portion of the internal volume of the internal chamber of the air tank, the upwardly projecting portion being positioned to remain above the water as the air tank moves between the raised position and the lowered position and sized to trap sufficient air therein to provide sufficient buoyancy to prevent submersion of an upper portion of the upwardly projecting portion when all other pressurized air is released from the internal chamber.

20. The watercraft lift of claim 8 wherein each of the port and starboard air tanks of the forward and aft sets of air tanks has an upwardly projecting portion projecting above the upper side portion and defining a limited first portion of the internal volume of the internal chamber of the air tank, the upwardly projecting portion being positioned to remain above the water as the air tank moves between the raised position and the lowered position and sized to trap sufficient air therein to provide sufficient buoyancy to prevent submersion of an upper portion of the upwardly projecting portion when all other pressurized air is released from the internal chamber.

21. The watercraft lift of claim 8 further including for each of the port and starboard air tanks of the forward and aft sets of air tanks: a blower, at least a first valve connected to the blower to provide pressurized air to the internal chamber of the air tank, and at least a second valve by which pressurized air is released from the internal chamber of the air tank, and wherein each of the port and starboard air tanks of the forward and aft sets of air tanks has an upwardly projecting portion projecting above the upper side portion and defining a limited first portion of the internal volume of the internal chamber of the air tank, the upwardly projecting portion being positioned to remain above the water as the air tank moves between the raised position and the lowered position, each of the upwardly projecting portions having an upper end at which the blower, first valve and second valve for the air tank are positioned.

22. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon and a lower side portion, the forward port and starboard air tanks each having an upwardly projecting portion located adjacent to the laterally outward side thereof and projecting upward above the upper side portion, the upwardly projecting portion being defined by a laterally outward side portion and a laterally inward side portion, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the aft port and starboard air tanks each having an upper side portion for receiving and supporting the watercraft thereon and a lower side portion, the aft port and starboard air tanks each having an upwardly projecting portion located adjacent to the laterally outward side thereof and projecting upward above the upper side portion, the upwardly projecting portion being defined by a laterally outward side portion and a laterally inward side portion, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, the aft set of air tanks being retained in a position aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the upwardly projecting portions of each of the port and starboard air tanks of the forward and aft sets of air tanks has a reinforcing member attached to one of the laterally outward side portion and the laterally inward side portion of the upwardly projecting portion and extending toward the other of the laterally outward side portion and the laterally inward side portion;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position;

each of the port and starboard air tanks of the forward and aft sets of air tanks having a second aperture for selectively providing pressurized air to the internal chamber of the air tank; and each of the upwardly projecting portions of each of the port and starboard air tanks of the forward and aft sets of air tanks has a first aperture in the laterally outward side portion and a second aperture in the laterally inward side portion of the upwardly projecting portion, and the reinforcing member has first and second open ends with an interior passageway extending between the first and second open ends, the first open end being attached to the laterally outward side portion in sealing engagement therewith at the first aperture with the passageway in communicate with the first aperture and the second open end being attached to the laterally inward side portion in sealing engagement therewith at the second aperture with the passageway in communicate with the second aperture to prevent leakage of pressurized air from within the upwardly projecting portion through the passageway while the passageway of the reinforcing member provides a pass-through between the laterally outward side portion and inward side portion of the upwardly projecting portion.

23. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon and a lower side portion, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the aft port and starboard air tanks each having an upper side portion for receiving and supporting the watercraft thereon and a lower side portion, the aft set of air tanks being retained in a position aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position, the first aperture having a downwardly projecting lip extending thereabout to limit the pressurized air released from the internal chamber of the air tank as the lateral angle of the air tank changes as a result of wave action of the water; and each of the port and starboard air tanks of the forward and aft sets of air tanks having a second aperture for selectively providing pressurized air to the internal chamber of the air tank.

24. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon and a lower side portion, the forward port and starboard air tanks each having an upwardly projecting portion located adjacent to the laterally outward side thereof and projecting upward above the upper side portion, the upwardly projecting portion being defined by a laterally outward side portion and a laterally inward side portion, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the aft port and starboard air tanks each having an upper side portion for receiving and supporting the watercraft thereon and a lower side portion, the aft port and starboard air tanks each having an upwardly projecting portion located adjacent to the laterally outward side thereof and projecting upward above the upper side portion, the upwardly projecting portion being defined by a laterally outward side portion and a laterally inward side portion, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, the aft set of air tanks being retained in a position aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position;

each of the port and starboard air tanks of the forward and aft sets of air tanks having a second aperture and a blower connected to the second aperture and mounted on the air tank to selectively provide pressurized air to the internal chamber of the air tank;

each of the port and starboard air tanks of the forward and aft sets of air tanks having a third aperture to selectively release pressurized air from the internal chamber of the air tank; and each of the port and starboard air tanks of the forward and aft sets of air tanks having a first valve connected between the second aperture and the blower for the air tank to control the flow of pressurized air to the internal chamber of the air tank, and a second valve connected to the third aperture to control the flow of pressurized air released from the internal chamber of the air tank, with the first valve, the second valve and the blower for each of the port and starboard air tanks of the forward and aft sets of air tanks are mounted on the upwardly projecting portion of the air tank.

25. The watercraft lift of claim 14 wherein the first valve, the second valve and the blower of each of the port and starboard air tanks of the forward and aft sets of air tanks are mounted atop the upwardly projecting portion of the air tank.

26. The watercraft lift of claim 24 wherein the upwardly projecting portion has a top portion extending between the laterally inward side portion and the mid-portion of the laterally outward side portion, the first valve, the second valve and the blower of each of the port and starboard air tanks of the forward and aft sets of air tanks are mounted atop the top portion of the upwardly projecting portion of the air tank.

27. A watercraft lift for raising and lowering a watercraft in water, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon and a lower side portion, the forward port and starboard air tanks each having an upwardly projecting portion located adjacent to the laterally outward side thereof and projecting upward above the upper side portion, the upwardly projecting portion being defined by a laterally outward side portion and a laterally inward side portion, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to prevent submersion of an upper portion of the upwardly projecting portion when all other pressurized air is released from the internal chamber, each of the forward port and starboard air tanks having sufficient rigidity to not collapse when pressurized air therein is reduced;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the aft port and starboard air tanks each having an upper side portion for receiving and supporting the watercraft thereon and a lower side portion, the aft port and starboard air tanks each having an upwardly projecting portion located adjacent to the laterally outward side thereof and projecting upward above the upper side portion, the upwardly projecting portion being defined by a laterally outward side portion and a laterally inward side portion, the upwardly projecting portion defining a limited first portion of the internal volume of the internal chamber of the air tank and being positioned to remain above the water as the air tank moves between a raised position and a lowered position and sized to trap sufficient air therein to provide sufficient buoyancy to provide sufficient buoyancy to prevent submersion of an upper portion of the upwardly projecting portion when all other pressurized air is released from the internal chamber, the aft set of air tanks being retained in a position aft of the forward set of air tanks, each of the aft port and starboard air tanks having sufficient rigidity to not collapse when pressurized air therein is reduced, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

a bunk support leg having an upper portion and a lower portion;

a bunk for supporting the watercraft thereon, the bunk being attached to the upper portion of the bunk support leg;

each of the port and starboard air tanks of the forward and aft sets of air tanks having a receiving socket formed in the upper side portion, the receiving socket being sized to removably receive therein the lower portion of the bunk support leg;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position; and each of the port and starboard air tanks of the forward and aft sets of air tanks having a second aperture for selectively providing pressurized air to the internal chamber of the air tank.

28. The watercraft lift of claim 27 wherein the receiving socket being a through hole in the air tank passing fully therethough from the upper side portion to the lower side portion.

29. The watercraft lift of claim 28 wherein each of the port and starboard air tanks of the forward and aft sets of air tanks has a first aperture in the upper side portion and a second aperture in the lower side portion, and the socket is a channel member having first and second open ends with an interior passageway extending between the first and second open ends, the first open end being attached to the upper side portion in sealing engagement therewith at the first aperture with the passageway in communicate with the first aperture and the second open end being attached to lower side portion in sealing engagement therewith at the second aperture with the passageway in communicate with the second aperture to prevent leakage of pressurized air from within the air tank through the passageway.

30. A watercraft lift for raising and lowering a watercraft in water, comprising:

a plurality of air tanks each having an internal chamber configured to receive and release pressurized air, the air tanks each having an upper side portion for receiving and supporting the watercraft thereon and a lower side portion, the air tanks each having sufficient rigidity to not collapse when pressurized air therein is reduced, the internal chambers of the air tanks in combination having sufficient internal volume that when sufficient pressurized air is received therein the air tanks have sufficient buoyancy to rise to a raised position with the watercraft out of the water when the watercraft is positioned on the upper side portions of the air tanks, and that when sufficient pressurized air is released from the internal chambers of the air tanks the air tanks lose sufficient buoyancy to sink to a lowered position sufficiently submerged to receive and deploy the watercraft;

the air tanks each having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position;

the air tanks each having a second aperture for selectively providing pressurized air to the internal chamber of the air tank;

the air tanks each having a blower to selectively provide the pressurized air to the internal chamber of the air tank and a first electronically activated valve connected between the second aperture and the blower for the air tank to control the flow of pressurized air to the internal chamber of the air tank; and a controller to electronically activate the operation of the first valve, the controller being configured to initially apply a first electronic signal at an initial power level to the first valve for a set period of time to activate the first valve, and at the expiration of the period of time then apply a second electronic signal at a power level less than the initial power level to the first valve for continued activation of the first valve.

31. The watercraft lift of claim 30 wherein the first and second electronic signals are pulse width modulated with the first electronic signal having a first activation control pulse width and the second electronic signal having a second activation control pulse width, the second activation control pulse width being shorter than the first activation control pulse width.

32. The watercraft lift of claim 30 wherein the air tanks each further includes a third aperture to selectively release pressurized air from the internal chamber of the air tank and a second electronically activated valve connected to the third aperture to control the flow of pressurized air released from the internal chamber of the air tank; and the controller electronically activates the operation of the second valve, the controller being configured to initially apply a third electronic signal at an initial power level to the second valve for a set period of time to activate the second valve, and at the expiration of the period of time then apply a fourth electronic signal at a power level less than the initial power level to the second valve for continued activation of the second valve.

33. The watercraft lift of claim 32 wherein the first and second electronic signals are pulse width modulated with the first electronic signal having a first activation control pulse width and the second electronic signal having a second activation control pulse width, the second activation control pulse width being shorter than the first activation control pulse width, and the third and fourth electronic signals are pulse width modulated with the third electronic signal having a first activation control pulse width and the second electronic signal having a second activation control pulse width, the second activation control pulse width being shorter than the first activation control pulse width.

34. A watercraft lift for raising and lowering a watercraft in water, comprising:

a plurality of air tanks each having an internal chamber configured to receive and release pressurized air, the air tanks each having an upper side portion for receiving and supporting the watercraft thereon and a lower side portion, the air tanks each having sufficient rigidity to not collapse when pressurized air therein is reduced, the internal chambers of the air tanks in combination having sufficient internal volume that when sufficient pressurized air is received therein the air tanks have sufficient buoyancy to rise to a raised position with the watercraft out of the water when the watercraft is positioned on the upper side portions of the air tanks, and that when sufficient pressurized air is released from the internal chambers of the air tanks the air tanks lose sufficient buoyancy to sink to a lowered position sufficiently submerged to receive and deploy the watercraft;

the air tanks each having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position;

the air tanks each having a second aperture for selectively providing pressurized air to the internal chamber of the air tank;

the air tanks each having a blower to selectively provide the pressurized air to the internal chamber of the air tank;

the air tanks each having a sensor positioned in the internal chamber of the air tank for the detection of water in the internal chamber above a preselected level; and a controller to electronically activate the operation of the blower for the air tank to provide pressurized air to the internal chamber of the air tank with the sensor detecting water in the internal chamber above the preselected level.

35. The watercraft lift of claim 34 wherein the sensor comprises two spaced apart wires suspended inside the internal chamber of the air tank and the controller detects water in the internal chamber above the preselected level by detecting lowering of the resistance between the wires resulting from their immersion in the water within the internal chamber.

36. The watercraft lift of claim 35 wherein upon detection by the sensor of water in the internal chamber of the air tank above the preselected level the controller electronically activates the operation of the blower for the air tank for a predetermined time period, and subsequently the controller repeatedly determines after the termination of the prior predetermined time period whether water is still detected in the internal chamber above the preselected level and if water is detected in the internal chamber above the preselected level again electronically activates the operation of the blower for the air tank for another predetermined time period.

37. A watercraft lift for raising and lowering a watercraft in water and connecting the watercraft lift to a dock having a vertical retainer member attached to the dock, comprising:

a forward set of air tanks including a forward port air tank having an internal chamber configured to receive and release pressurized air and a forward starboard air tank having an internal chamber configured to receive and release pressurized air, the forward port and starboard air tanks each having a laterally outward side and a laterally inward side, the laterally inward sides of the forward port and starboard air tanks being located adjacent to each other, the forward port and starboard air tanks each having an upper side portion for receiving and supporting the watercraft thereon and a lower side portion;

an aft set of air tanks including an aft port air tank having an internal chamber configured to receive and release pressurized air and an aft starboard air tank having an internal chamber configured to receive and release pressurized air, the aft port and starboard air tanks each having a laterally outward side and a laterally inward side, the laterally inward sides of the aft port and starboard air tanks being located adjacent to each other, the aft port and starboard air tanks each having an upper side portion for receiving and supporting the watercraft thereon and a lower side portion, the aft set of air tanks being retained in a position aft of the forward set of air tanks, the internal chambers of the forward and aft port and starboard air tanks in combination having sufficient internal volume that when sufficient pressurized air is received therein the air tanks have sufficient buoyancy to rise to a raised position with the watercraft out of the water when the watercraft is positioned on the upper side portions of the forward and aft port and starboard air tanks, and that when sufficient pressurized air is released from the internal chambers of the forward and aft port and starboard air tanks the forward and aft port and starboard air tanks lose sufficient buoyancy to sink to a lowered position sufficiently submerged to receive and deploy the watercraft;

each of the port and starboard air tanks of the forward and aft sets of air tanks having a first aperture in the lower side portion positioned to be below the water as the air tank moves toward the lowered position, the first aperture permitting the passage of water into the internal chamber of the air tank when pressurized air is released from the internal chamber and the air tank sinks toward the lowered position and permitting the passage of water out of the air tank when pressurized air is provided to the internal chamber and the air tank rises toward the raised position;

each of the port and starboard air tanks of the forward and aft sets of air tanks having a second aperture to selectively provide pressurized air to the internal chamber of the air tank; and an elastomeric connector having a first end attached to the one of the port and starboard air tanks of the forward set of air tanks oriented toward the dock and a second end slidably received on the vertical retainer member attached to the dock to permit upward and downward movement of the watercraft lift relative to the dock.

* * * * *